US010465393B1

(12) United States Patent
Bradford

(10) Patent No.: US 10,465,393 B1
(45) Date of Patent: Nov. 5, 2019

(54) APPARATUS, SYSTEM AND METHOD FOR PANELIZING AND INSTALLING WALL AND ROOF PANELS

(71) Applicant: Jared Bill Bradford, Visalia, CA (US)

(72) Inventor: Jared Bill Bradford, Visalia, CA (US)

( * ) Notice: Subject to any disclaimer, the term of this patent is extended or adjusted under 35 U.S.C. 154(b) by 0 days.

(21) Appl. No.: 16/057,760

(22) Filed: Aug. 7, 2018

Related U.S. Application Data

(60) Provisional application No. 62/607,920, filed on Dec. 20, 2017.

(51) Int. Cl.
*E04B 9/00* (2006.01)
*E04F 21/18* (2006.01)

(52) U.S. Cl.
CPC ..... *E04F 21/1883* (2013.01)

(58) Field of Classification Search
CPC ..... E04F 21/1883
USPC ..... 52/474
See application file for complete search history.

(56) References Cited

U.S. PATENT DOCUMENTS 2,496,571 A * 2/1950 Wagner ..... E04F 21/1883 425/123
2,847,755 A * 8/1958 Mummert ..... B65D 88/34 29/429
3,333,322 A * 8/1967 Toffolon ..... E04B 1/3205 29/463
3,673,675 A * 7/1972 Eggert, Jr. ..... B60P 1/02 29/469
3,866,300 A * 2/1975 Bell ..... E04F 21/1883 156/574
3,934,386 A * 1/1976 Al Haj Issa ..... E04B 1/35 52/745.13
4,123,879 A * 11/1978 Blodee ..... E04B 2/7427 52/241
4,257,158 A * 3/1981 Casutt ..... B62D 65/02 254/45
4,348,797 A * 9/1982 Hutchison ..... F24S 23/74 29/434
4,452,587 A * 6/1984 Laws ..... B21B 1/26 165/135
4,637,540 A * 1/1987 Fujita ..... B23Q 1/525 228/48
5,095,673 A * 3/1992 Ward ..... E04D 13/1637 52/404.2
6,467,236 B1 * 10/2002 Schlegel ..... E04B 9/00 248/317
8,316,605 B2 11/2012 Oberg
(Continued)

*Primary Examiner* — Basil S Katcheves
(74) *Attorney, Agent, or Firm* — Richard A. Ryan

(57) ABSTRACT

An apparatus, system and method of forming a plurality of panels into a panelized section of panels and installing the panelized section on the frame of a building to form a wall or roof of the building. The apparatus has a panelizing assembly which sits on the ground or other surface to allow the user to accurately position panels for the panelized section and a lifting apparatus that helps form the panelized section and lifts the panelized section to the building's frame. The panels are aligned using positioning devices on the panelizing assembly and cap members on the lifting assembly, each of which have profiles that correspond to the profile of the panel so the panel is squeezed between the lifting assembly and the panelizing assembly. Panels from a bundle of panels are positioned on a frame of the panelizing assembly using a cart that rolls on a rail track.

25 Claims, 15 Drawing Sheets

(56) References Cited

U.S. PATENT DOCUMENTS

| | | | | |
|---|---|---|---|---|
| 2003/0154614 | A1* | 8/2003 | Rice | A47G 1/205<br>33/613 |
| 2008/0083183 | A1* | 4/2008 | Rymell | E04D 3/3608<br>52/408 |
| 2010/0229367 | A1* | 9/2010 | Franklin | F24S 25/636<br>29/464 |

* cited by examiner

APPARATUS, SYSTEM AND METHOD FOR PANELIZING AND INSTALLING WALL AND ROOF PANELS

CROSS-REFERENCE TO RELATED APPLICATIONS

This patent application claims priority to U.S. Provisional Patent Application No. 62/607,920 filed Dec. 20, 2017.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to apparatuses, systems and methods that are particularly configured to efficiently, safely and quickly install wall and roof panels onto a building. Specifically, the present invention relates to such apparatuses, systems and methods that allow persons to quickly prepare wall and roof panels for use as cladding on a building and to assist with more efficiently and safely installing the wall and roof panels onto the building. More specifically, the present invention relates to such apparatuses, systems and methods that allow the user to combine multiple panels together, position the combined panels onto the frame of the building and quickly, easily and safely attach the combined panels to the frame to form a wall or roof of the building.

B. Background

Metal cladding, which is the exterior wall and roof material installed on pre-engineered metal or steel buildings, is generally grouped into three categories, namely, exposed fastener panels, concealed fastener panels and standing seam. Metal cladding is typically machine formed through the use of roll-formers, sheet metal brakes or sheet metal folders from large coils of pre-coated sheet metal, typically ranging in thicknesses of 18 to 29 gauge, to construct the finished or installed shape of the metal panels, which typically range in width between two and four feet and may be of a wide rage of widths, with some panels be as long as forty feet or more. The typical, mechanical manufacturing method, which has been in use for several decades, produces a somewhat standardized appearance and profile for the metal panels. As a result, there are several primary styles of panels that are sold by the core group of metal building manufacturers in the United States and globally. While metal panels may have different profiles, nearly all of the different styles of panels are corrugated, meaning they comprise a series of ribs and valleys between the ribs, and they are specifically configured to provide the structural integrity that is necessary to resist the loads which are imposed on the building, weatherproof the building envelope and provide an aesthetic appeal for the building. Each metal panel and its associated corrugations from the forming process for a particular style of panel are designed to overlap and interlock or "corrugate" with each other to provide a continuous, repeatable and predictable pattern on the surface of the wall or roof.

The typical method that is utilized to install exterior metal cladding on a building is generally accomplished with a crew of three to five workers who install the metal panels from a position on the ground. The panels are received at the job site in stored bundles that usually comprise thirty to forty panels per bundle, with the panels in the bundle being pre-drilled for installation on a building. A metal panel is removed from the bundle of panels and carried by hand to the leading edge of the wall or roof structure. The metal panel is then lifted into place against the superstructure or frame of the building using a tethered clamp or by lifting the panels progressively vertical at an interval that is determined by the width of a single manufactured metal panel. After positioning the wall or roof panel on the frame, the user checks the panel for vertical and/or horizontal alignment, measures the panel for squareness and then secures the panel to the building's frame using screws or other mechanical fasteners that connect the wall or roof panels to the building's frame. The cladding for a building typically comprises the manufactured metal panels being installed over a thermal blanket insulation with laminated scrim or vinyl facing, or with a variety of other materials, such as gypsum wall board, exterior sheathing or the like.

As well known to persons skilled in the relevant art, the standard metal building superstructure frame is composed of a plurality of rigid frame members, typically referenced as posts for the walls and beams for the roof, with a plurality of horizontal girts spanning from between rigid frame members (posts) for the walls and a plurality of horizontal purlins spanning from between rigid frame members (beams) for the roof. For installation of wall panels, the metal panels are typically attached to the girts by installing a screw or other connector, as may be required or recommended by the manufacturer of the panel, through the panel into a girt. For installation of the roof panels, the metal panels are typically attached to the purlins by installing a screw or other connector, as may be required or recommended by the manufacturer of the panel, through the panel into a purlin.

As well known by persons who are skilled in the relevant art, the present apparatuses, systems and methods of installing panels, particularly metal panels on the superstructure/frame of a metal framed building, is known to be time consuming and inherently subject to errors with regard to the proper positioning and alignment of the panels. In particular, if the panels are not carefully positioned against the frame, the finished wall of panels can lack uniformity with regard to overhang distances and not have the desired squareness, which can result in saw-tooth panel edges on the squarely framed superstructure. In addition, the resulting wall or roof can have openings in the panels where apertures in a panel were not aligned with the metal girt or purlin to which the panel is attached.

Based on the consistency of the general configuration of the metal panels, from one style of panel to another, various types of tools, equipment, systems and methods have been developed to assist the workers with handling and installing the metal cladding on the frame of a building. Despite the existing apparatuses, systems and methods, what is needed is an improved apparatus, system and method for handling and installing panels on the frame of a building. More specifically what is needed is an improved apparatus, system and method for combining a plurality of separate wall or roof panels into a group of such panels, a process commonly referred to as "panelizing", and for installing the panelized panels on the frame of a building, or more specifically on the girts or purlins (which are hereinafter collectively referred to as the "building's frame" or "frame"). An improved apparatus, system and method should be configured to allow the user to quickly, easily and efficiently panelize a plurality of panels so the panelized panels can be installed, in a predictable manner, on the building's frame. To accomplish this, the improved apparatus, system and method should be configured to ensure the panelized panels are put together in a substantially true, flat and level plane so the panels can be properly placed against a wall or roof portion of the frame. The new apparatus, system and method should be configured to improve accuracy with regard to maintaining squareness and overhang distances of the panels so as to eliminate the possibility of saw-tooth panel edges on a squarely framed building frame and holes in the finished wall or roof. Preferably, the new apparatus, system and method should be easy to use and relatively inexpensive to manufacture.

SUMMARY OF THE INVENTION

The apparatus, system and method for panelizing and installing the panelized wall and roof panels of the present invention provides the benefits and solves the problems that are identified above. That is to say, the present invention discloses a new apparatus, system and method of panelizing a plurality of panels into a combined group of panels, or panelized section, that can then be easily, safely and efficiently attached to the frame of a building to form the building's wall or roof cladding. The apparatus, system and method of panelizing and installing wall and roof panels of the present invention allows the user to quickly install wall and roof panels on a building, such as a metal framed building, in a manner which is much safer and more efficient than present systems and methods of installing panels on the frame of a building. The new apparatus, system and method of the present invention can be utilized with a wide variety of different types, sizes and configurations of panels and building frames and whether such panels are made out of metal or other materials. In the preferred configurations of the various aspects of the present invention, the new apparatus, system and method are easy to use and relatively inexpensive to manufacture.

With regard to the apparatus, system and method for panelizing and installing wall and roof panels, the present invention takes advantage of the fact that preformed corrugated panels are inherently formed into a series of continuous, repeatable, and known patterns that can be predictably combined together (i.e., so they can be panelized). This aspect of the present invention is comprised of two primary working assemblies with varying attachments, options, and appurtenances that are utilized to aid in the assembly and installation of exterior cladding. One of these working assemblies is configured as a layout table or jig, referred to herein as the panelizing assembly, having a support frame, alignment structure, rail tracks and a rolling cart. The other working assembly is a lifting assembly that is placed on the panelized section while it is on the panelizing assembly, attached to the panelized section and then utilized to raise the panelized section into place to form a wall or roof. To form the panelized sections, the ground or other working surface based panelizing assembly holds the individual metal panels on a true and flat level plane while allowing the panels to be placed square with the alignment structure, which has a plurality of interchangeable blocks or dies that are cooperatively configured to engage the corrugation of the metal panels. The rolling cart allows the user to easily distribute and position the panels on the alignment structure to form the panelized section. The panelized section can be installed in a fraction of the time and at a much lower effort than the traditional single panel hand lifting installation method that is currently in use to attach panels to the walls and roof of a structure.

Once the individual panels are distributed on the panelizing assembly, a lifting assembly is lowered to be positioned against the outward or upper surface of the panelized section, with it's profile-specific cap members against the panels, to create a ballasted squeeze against the corrugated panels that ensures the distance between all corrugations is consistent and accurate. The lifting assembly is attached to form the panelized array of panels, namely the panelized section, and then lifted by the use of aerial lifting equipment (such as a crane, boom truck, reach lift forklift or the like). Because the array of panels or panelized section is formed on a controlled layout table, namely the panelizing assembly, located on the ground or other working surface, the present apparatus, system and method will greatly enhance the accuracy for maintaining the squareness and overhang distances of the panels. As will be readily appreciated by persons who are skilled in the relevant art, this new assemblies will virtually eliminate the likelihood there will be saw-tooth panel edges on a squarely framed superstructure. The panelized section, attached to the lifting assembly, is then lifted into place by the crane, boom truck, reach lift forklift or other aerial lifting equipment. The new lifting assembly is configured to be rigid enough to support and maintain a flat, square, and consistent array of metal panels, in the form of the panelized section, through each axis of aerial rotation, from horizontal to vertical. Once the panelized array of wall or roof panels is lifted to the desired position on a wall or roof, the wall or roof installers will securely attach the corrugation of the trailing side of the new panelized section to the leading side of the last installed panelized section, verify that the leading edge of the newly added panelized section is within the allowed vertical tolerance and then secure the entire panelized section to the building's frame with screws or other mechanical fasteners (typically as may be recommended or required by the manufacturer of the panels).

The present invention, which includes the apparatus having multiple assemblies, the system and the intended method of use of the apparatus, will increase production, minimize exposure to job site injuries or falls and standardize the installation process with regard to the erection or installation of cladding materials onto the framed superstructure of a building, such as the metal panels which are typically utilized in metal building construction. The new apparatus for panelizing and installing the panelized section of wall or roof panels, which comprises the panelizing assembly, or layout table or jig, for forming a panelized section and the lifting assembly to lift the panelized section into place, allows the user to easily, quickly and efficiently combine a plurality of wall and roof panels into a panelized section that can be more quickly and safely installed on the building's superstructure utilizing overhead cranes, boom trucks, reach lift forklifts or like lifting equipment. Due to the benefits of the present invention, persons who are skilled in the relevant art will readily appreciate that the new apparatus, system and method that are disclosed herein will likely eliminate the need for workers to individually lift wall and roof panels by hand, as is presently done with regard to wall and roof panels.

In one embodiment of the present invention, the new apparatus for panelizing and installing a plurality of wall panels on the frame of a building generally comprises a panelizing assembly and a cooperatively configured lifting assembly. The panelizing assembly has a support frame and one or more panel alignment structures that are supported by the support frame. Each of the panel alignment structures are structured and arranged to receive a plurality of panels thereon and to position the panels into the panelized section. The lifting assembly has a support lift structure and one or more panel lifters that are attached to or integral with the support lift structure so as to be supported by the support lift structure. The support lift structure is structured and arranged to stiffen the lifting assembly so as to support the panelized section when it is being moved to the frame of the building and while being attached to the frame. Each of the panel lifters has a plurality of attachment mechanisms that are structured and arranged to engage the panels which are on the panelizing assembly so the plurality of panels can be formed into the panelized section. The attachment mechanisms also secure the lifting assembly to the panelized section so the panelized section may be lifted to the frame of the building. The panelizing assembly and the lifting assembly are cooperatively configured to squeeze the panelized section between the panel alignment structure of the panelizing assembly and the panel lifters of the lifting assembly.

In a preferred configuration, each of the panel alignment structures has an alignment frame, a rail track having rail members that are attached to or integral with the alignment frame and a panel cart which is moveably engaged with the rail track so as to move from a panel cart area at a first side of the support frame to a second side of the support frame. The panel cart has a cart frame that is sized and configured to moveably support a bundle of panels. The user moves the bundle of panels between the first side and the second side of the support frame to position panels on the alignment frame. Each of the panel alignment structures has a plurality of panel positioning devices that are attached to or integral with the alignment frame and configured to extend above an upper surface of the alignment frame. Each of the panel positioning devices area sized and configured to hold a panel on the panelizing assembly. The panel positioning devices have a device profile that is sized and configured in corresponding relation to a panel profile of the panel so as to securely engage an inward/lower surface of the panel when the panel is placed on the alignment frame of the panel alignment structure. Each of the attachment mechanisms, which may be elongated cap members, have a profile that is also in corresponding relation, though opposite of the device profile, with the panel profile of the panel so as to securely engage an outward/upper surface of the panel. Each of the attachment mechanisms engage the panel opposite the inward/lower surface of the panel engaged by the panel positioning device when the lifting device is placed on the panel so as to squeeze the panel between the attachment mechanism of the lifting assembly and the panel positioning device of the panelizing assembly. The attachment mechanisms have one or more mounting apertures that are sized and positioned to be utilized to connect the attachment mechanism (i.e., the cap member) to the panel at the panel positioning device so as to secure the lifting assembly to the panelized section.

In one configuration, the support lift structure of the lifting assembly is pivotally attached to each of the panel lifters so as to allow the panelized section to pivot when the panelized section is lifted by the lifting assembly. A pivot locking device can be utilized to allow the user to selectively allow, limit and/or prevent pivoting of the panel lifters relative to the support lift structure. The support lift structure can comprise one or more trusses and one or more spreader frames, with each of the trusses being attached to or integral with one of the one or more panel lifters and each of the spreader frames being attached to or integral with the one or more trusses. The lifting assembly can have a plurality of panel lifters and a length adjusting mechanism associated with the support lift structure, with the length adjusting mechanism being structured and arranged to adjust the length of each of the one or more spreader frames so as change the position of one or more of the panel lifters relative to the other panel lifters.

In another embodiment of the present invention, the new system for panelizing and installing a plurality of wall panels on the frame of a building generally comprises the above described panelizing and lifting apparatus and the panels necessary to form the panelized section.

In yet another embodiment of the present invention, the new method for panelizing and installing a plurality of wall panels on the frame of a building generally comprises the steps of: (a) obtaining a panelizing and lifting apparatus having a panelizing assembly and a lifting assembly; (b) placing the panelizing assembly on a surface, with the panelizing assembly having a support frame supporting a plurality of panel alignment structures and each of the panel alignment structures having an alignment frame and a plurality of panel positioning devices on the alignment frame, each of the panel positioning devices positioned on the alignment frame so as to extend above an upper surface of the alignment frame, each of the panel positioning devices having a device profile; (c) placing a panel on the alignment frame in engagement with one or more of the panel positioning devices, the panel having been selected to form a panelized section comprising a plurality of such panels, with the panel having a panel profile, the device profile of each of the panel positioning devices configured in corresponding relation to the panel profile so as to engage an inward/lower surface of the panel; (d) moving the lifting assembly to be in engagement with an outward/upper surface of the panel, the lifting assembly comprising a support lift structure supporting a plurality of panel lifters, each of the panel lifters having a plurality of cap members, each of the cap members having a cap profile in corresponding relation to the panel profile of the panel; (e) positioning the cap members so as to be in alignment with panel positioning devices with the panel disposed between the cap members and the panel positioning devices; (f) attaching the lifting assembly to the panel while squeezing the panel between the lifting assembly and the panelizing assembly to allow the user to form the panelized section on the panelizing assembly using appropriately configured connectors; (g) lifting the lifting assembly and the panelized section off of the panelizing assembly; (h) moving the lifting assembly and the panelized section to a frame of the building and attaching the panelized section to the frame to form one of the wall or the roof of the building; and (i) disconnecting the lifting assembly from the panelized section. In a preferred configuration of the above method, each of the panel alignment structures further comprises a rail track that is associated with the alignment frame and a panel cart which is moveably engaged with the rail track an alignment frame. The method further comprising the step of positioning a bundle of panels on the panel cart, moving the panel cart on the rail track and removing the panel from the bundle of panels prior to panel placing step.

Accordingly, the primary objective of the present invention is to provide an improved apparatus, system and method for panelizing and installing wall and roof panels on the frame of a building that has the benefits described above and elsewhere herein and which overcomes the various limitations and problems that are associated with currently available apparatuses, systems and methods for handling and installing wall and roof panels on the frame of a building.

It is also a primary objective of the present invention to provide an improved apparatus, system and method for panelizing and installing wall and roof panels that can be utilized to easily, quickly and accurately panelize a plurality of wall or roof panels into a single array of panels that can then be lifted into position against the frame of a building so the users can more accurately, efficiently and safely install the panels on the building.

An important aspect of the present invention is that it provides a new apparatus, system and method for panelizing and installing wall and roof panels that achieves the goals of the above-described objectives.

Another important aspect of the present invention is that it provides an improved apparatus, system and method for panelizing and installing wall and roof panels on the superstructure frame of a building which comprises a panelizing assembly that is configured as a layout table or jig having a support frame, panel alignment structure, rail tracks and a rolling cart that are cooperatively configured to allow the user to quickly and accurately form a plurality of individual wall or roof panels into a panelized array of such panels for improved installation of the panels onto the frame of a building.

It is also an important aspect of the present invention to provide an improved apparatus, system and method for panelizing and installing wall and roof panels that comprises a lifting assembly which is structured and arranged to attach to a panelized section comprising an array of wall or roof panels to easily, quickly and safely lift and place the panelized array in position to install the panels on a frame of a building to form the walls or roof thereof.

Yet another important aspect of the present invention is that it provides an improved apparatus, system and method for panelizing and installing wall and roof panels which is relatively easy to use and inexpensive to manufacture.

As will be explained in greater detail by reference to the attached figures and the description of the preferred embodiments which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. As will be readily understood and appreciated, the scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth in the text below. The enclosed figures are illustrative of one or more potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the panelizing and lifting apparatus, system and method of the present invention and panels and buildings with which the apparatus, system and method may be utilized therewith, persons who are skilled in the art will readily appreciate that the present invention is not so limited. In addition, the exemplary embodiments of the present apparatus, system and method are shown and described with only those components which are required to disclose the present invention. It may be that some of the necessary elements for attaching and using the present invention are not shown or are not necessarily described below, but which are well known to persons skilled in the relevant art. As will be readily appreciated by such persons, the various elements of the present invention that are described below may take on any form consistent with forms that are readily realized by persons of ordinary skill in the art having knowledge of panels and buildings and other structures which use or can utilize such panels.

Figure 1:
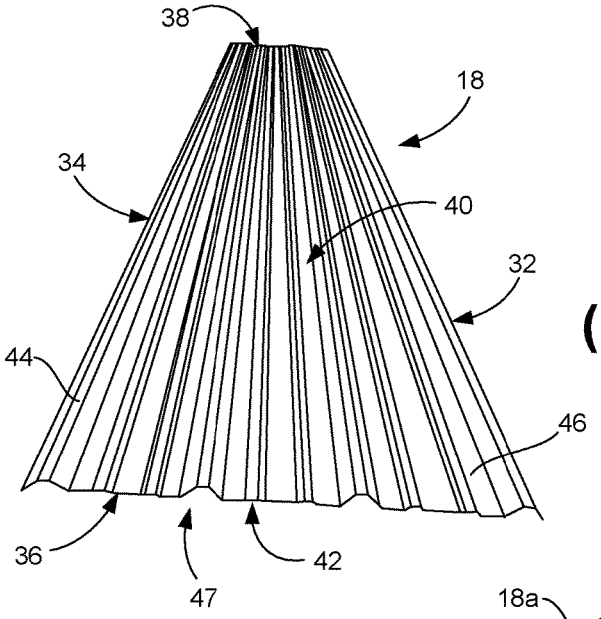
FIG. 1 (PRIOR ART)
FIG. 1 is a prior art end perspective view of a wall or roof panel of the type that is commonly utilized for the exterior cladding for the walls and roof of a metal building.
Figure 2:
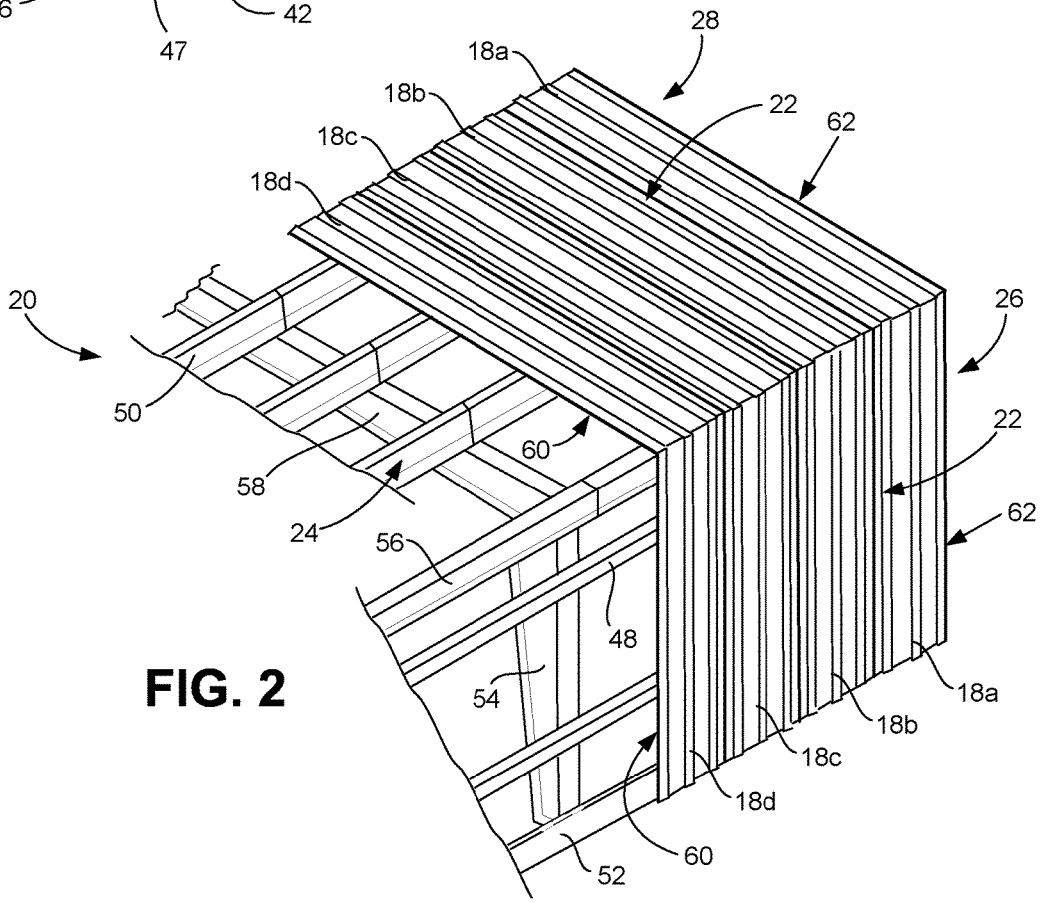
FIG. 2 is a front view of a panelized section of panels shown installed on the frame of a building after having utilized the apparatus of the present invention to form the panelized section and lift and position the panelized section against the frame of the building.
Figure 3:
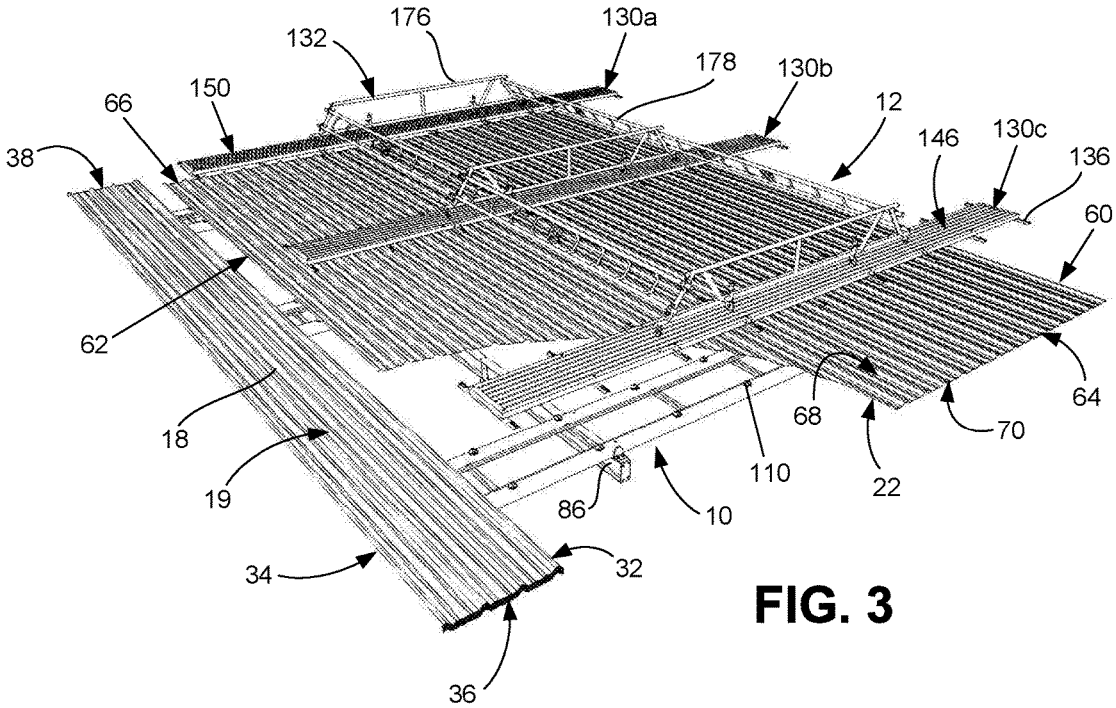
FIG. 3 is an end perspective view of the apparatus for panelizing and installing panels that is configured according to a preferred embodiment of the present invention showing the panelizing assembly for forming a plurality of wall or roof panels into a panelized section and the lifting assembly for lifting the panelized section, with the apparatus shown having a plurality of panels positioned on the panelizing assembly and the lifting assembly positioned above the panels that have been panelized and with a section of the panelized panels removed to show the panelizing assembly under the panelized section.
Figure 5:
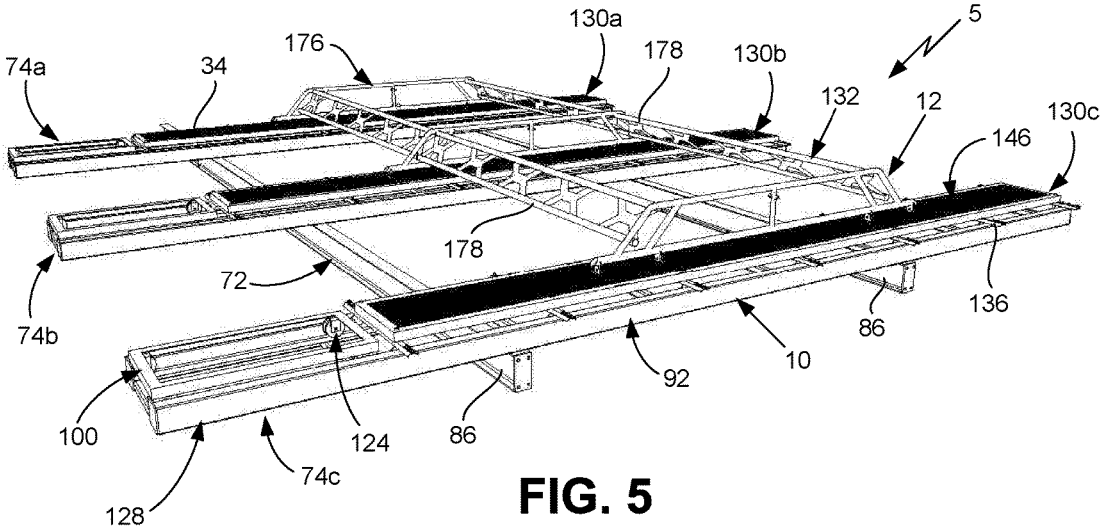
FIG. 5 is a side perspective view of a panelizing and lifting apparatus that is configured according to a preferred embodiment of the present invention shown with the lifting assembly positioned on the upper surfaces of the panelizing assembly.
Figure 6:
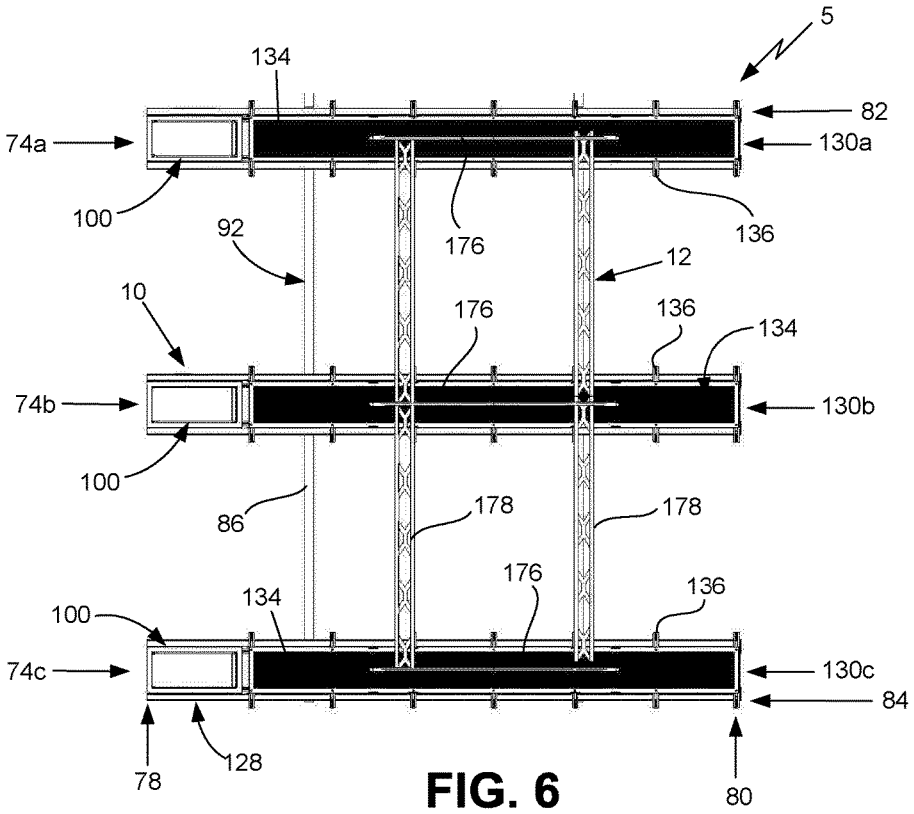
FIG. 6 is a top view of the panelizing and lifting apparatus of FIG. 2.
Figure 24:
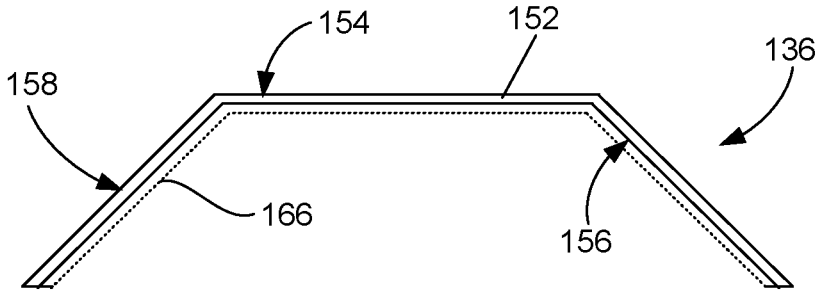
FIG. 24 is an end view of one of the cap members of the lifting assembly of FIG. 15, with the cap member shown having a liner on the lower surface thereof.

A panelizing and lifting apparatus that is configured pursuant to one or more embodiments of the present invention is shown generally as 5 in FIGS. 5 and 6. The panelizing and lifting apparatus 5 comprises a panelizing assembly 10 and a lifting assembly 12. The panelizing assembly 10 is shown in FIGS. 3, 5-11. The lifting assembly 12 is shown in FIGS. 3, 5-7 and 15-18. A system that is configured pursuant to one or more embodiments of the present invention is shown generally as 14 in FIG. 3. A method of utilizing that is configured pursuant to one or more embodiments of the present invention is shown as 16 in the flow chart of FIG. 24. The new system 14 and method 16 utilize the new panelizing and lifting apparatus 5. As described in more detail below and best shown in FIGS. 1-3, the panelizing and lifting apparatus 5, system 14 and method 16 are structured and arranged to be utilized to more efficiently and safely install a plurality of panels 18, such as metal panels or the like, on a building 20 to define the sides and/or roof of the building 20. More specifically, the new panelizing assembly 10 is structured and arranged to allow the users thereof to quickly, accurately and effectively group a plurality of panels 18 together into a panelized section 22 that can be easily and safely lifted, as a single unit, by the lifting assembly 12 to be attached to the superstructure frame 24 of a building so as to define the walls 26 and/or roof 28 of the building, as shown in FIGS. 2-3 and 24. In one embodiment, the system 14 of the present invention comprises the new panelizing and lifting apparatus 5 and a panelized section 22 that is formed from a plurality panels 18. In another embodiment, the system 14 includes a building 20 having a frame 24 to which the panelized section 22 is attached. In one embodiment, the method 16 of the present invention comprises, in part, the steps of forming a plurality of panels 18 into a panelized section 22 utilizing the panelizing assembly 10, lifting the panelized section 22 with the lifting assembly 12 and attaching the panelized section 22 to the frame 24 of a building 20 to define a wall 26 or roof 28 of the building 20.

With regard to the panelizing assembly 10, a wide variety of different types, sizes and configurations of panels 18 that can be panelized into a panelized section 22. An example of one type of prior art panel 18 that can be panelized by the panelizing assembly 10 of the present invention is shown in FIG. 1. Each panel 18 has a panel body 30 having a first side 32, second side 34, first end 36 and second end 38 that define the dimensions of the panel 18. The panel body 30 also has an upper or outward surface 40 and a lower or inward surface 42. When installed on a building 20, the panel 18 is positioned such that the inward surface 42 is placed against, directly or indirectly, the frame 24 of the building 20 to face in toward the interior of the building 20 with the outward surface 40 facing outward to define the exterior surface of the wall 26 or roof 28. A wide variety of different sizes and types of panels 18 can be utilized with the panelizing assembly 10 and be lifted into place, as a panelized section 22, by the lifting assembly 12 of the present invention. Specifically, the present invention is not limited to any type or size of panel 18 that is referenced or set forth herein. Instead, as will be readily appreciated by persons who are skilled in the art, the panelizing and lifting apparatus 5, system 14 and method 16 of the present invention can be utilized with a wide range of panels 18 to form the walls 26 and/or roof 28.

A very common type of metal panel 18 that is utilized for the cladding that forms the metal walls 26 and roof 28 of a building 20 is a corrugated steel sheet having a plurality of spaced apart and parallel, alternating ribs 44 and valleys 46, as shown in FIG. 1. Although the rib/valley configuration (i.e., the shape and size) of a panel 18 can vary considerably among the many manufacturers of corrugated panels 18, the valleys 46 are generally flat to form a lower plane that is in spaced apart relation from a top plane formed by the ribs 44. The corrugations of a panel 18 are described in terms of pitch and depth, with the pitch being the distance between the top or crest of two adjacent ribs 44 and the depth being the height from the top/crest of a rib 44 to the bottom of the adjacent valley 46. For a particular panel configuration, it is important for the pitch and depth to be uniform from one panel 18 to another in order for the panels 18 to be stackable for ease of transport and in order for the two adjoining panels 18 to be able to neatly overlap at their sides when joining the two panels 18 together. The uniform configuration for a particular type of panel 18 is identified herein as the panel profile 47, which for the panel 18 shown in FIG. 1 is the profile of ribs 44 and valleys 46 that is the same from panel 18 to panel 18 for that panel configuration. As will be readily appreciated by persons who are skilled in the art, the assemblies 10/12 of the present invention utilizes the common configuration of a particular panel profile 47 of a panel 18 to form the panelized section 22 that is then lifted and attached to the frame 24 of a building 20.

The panels 18 that can be utilized with the panelizing and lifting apparatus 5, system 14 and method 16 of the present invention can be, among others, of the type that are commonly known as exposed fastener, concealed fastener or standing seam panel installations. As well known to persons skilled in the art with regard to panels 18, particularly metal panels 18, exposed fastener panel installations result in the fasteners, such as self-drilling screws and the like, being visible and exposed to the environment. In use, the fasteners pass through the panels 18 to directly attach to the frame members, such as girts 48 and purlins 50, of the frame 24 of a typical building 20, as shown in FIG. 2. In prior art use, the fasteners penetrate the overlapping sections of the panel 18, locking them in place against the girts 48 or purlins 50. In contrast, concealed fastener panel installations utilize fasteners that are not visible on the exterior of the wall 26 or roof 28. Instead, the fasteners, such as snap lock joints and the like, are hidden inside the interlocking panel joints to create a smoother external appearance than exposed fastener panel installation. Like concealed panel installations, standing seam panel installation utilize a connection mechanism hidden from view. Standing seam panels are made of interlocking metal panels are held down with clips or the like that are positioned under the metal panels. A special crimping tool is utilized to crimp down and lock the seams to connect the panels to the wall girts 48 or purlins 50 of the frame 24 of the building 20 to form, respectively, the walls 26 or roof 28.

As set forth above, the panelizing and lifting apparatus 5, system 14 and method 16 of the present invention can be utilized with any type of panel 18 to form the panel 18 into the panelized section 22 that is then lifted in place against the girts 48 or purlins 50 of the building's frame 24, where the panelized section 22 is then attached to the frame 24 to form walls 26 or the roof 28. The assemblies 10/12, system 14 and method 16 can utilize any of the above or other panels 18, such that installation of the panels 18 (via panelized sections 22) to form walls 26 or a roof 28 will greatly benefit, with regard to accuracy, speed and safety, from the present inventions. For instance, blanket insulation, rigid board insulation, or other collateral materials can be joined to the panelized section 22 on the ground or other working surface 76 using the panelizing and lifting apparatus 5, system 14 and method 16 of the present invention to further gain the benefits of working from the ground or other surface 76 on the panelized support frame 72 to form the walls 26 and roof 28 of a building 20.

A typical metal building that can benefit from the new assemblies 10/12, system 14 and method 16 of the present invention has a base member 52 that rests on the foundation (not shown). A plurality vertical posts 54 connect to and extend upward from the base 52 to an eave strut 56 that defines the upper edge of the walls 26 of the building 20. One or more horizontally positioned girts 48 extend between and interconnect the posts 54. A plurality of beams 58 extend inward and slightly upward, for roofs 28 having a pitch (i.e., non-planar roofs 28), from the posts 54. The above description of the components and configuration of a building 20 that utilizes panels 18, particularly metal panels, is only an example of the components and configuration of a building 20 that is being utilized to describe the features and benefits of the present invention. The assemblies 10/12, system 14 and method 16 of the present invention can be utilized for any type of similarly configured building 20. As set forth in the Background, with regard to the prior art installation of panels 18 onto the walls 26 or roof 28 of a building, the panels 18 are individually placed against and attached to the base member 52, girts 48 and eave strut 56 to form the exterior cladding for the walls 26 and against and attached to the purlins 50 and eave strut 56 to form the exterior cladding for the roof 28. As set forth below, in the present invention a panelized section 22, comprising a plurality of panels 18, is placed against and attached to the same components in a manner that is faster, more accurate and safer.

The panelizing section 22, which comprises a plurality of joined panels 18, takes advantage of the fact that the panels 18 which are utilized for cladding for a building 20 are corrugated, to various degrees, so that the leading edge of one panel 18 is placed in interlocking relation with the trailing edge of another panel 18. In a typical prior art wall or roof installation for certain panels (i.e., exposed fastener panels), a first panel 18 is removed from a bundle of panels 19 (as shown in FIG. 3), lifted into place against the frame 24 of the building 20 and then secured into place against the frame 24 using screws or other fasteners, with the trailing edge of the first panel placed in alignment with one edge of the wall 26 or roof 28 and the leading edge of the panel positioned in the opposite direction (i.e., in the cladding/sheeting direction, such as toward the opposite edge of the wall or roof). A second panel is removed from the bundle of panels 19, lifted into place against the frame 24 with the trailing edge of the second panel in overlapping relationship with the leading edge of the first panel and then the second panel is secured in place against the first panel 18 and the frame 24 of the building 20. This process is repeated for each subsequent panel 18 until the entire wall 26 or roof 28, or at least the desired section thereof, is covered with the panels to form an outer layer or cladding of the building 20. Installing the cladding for a building 20 requires that each panel 18 be carefully lifted into place and positioned against the frame 24 so as to be properly aligned with the frame 24 and each prior and subsequent panel 18, which process is known to be quite time consuming and subject to errors. Unfortunately, even careful installation of the panels 18 on the frame 24 of a building 20 can result in the panels 18 not being properly aligned or otherwise positioned on the frame 24.

As described in more detail below, the panelizing assembly 10 of the present invention is structured and arranged to allow the user to create a panelized section 22 on the ground or other surface where the panels 28 can be more quickly and accurately joined together. The lifting assembly 12 allows the user to lift the panelized section 22 into place against the frame 24 of the building 20 as an entire unit or array of panels 18. Once lifted in place, a first panelized section 22 is joined to the frame 24 in the manner which is appropriate for the type of panels 18 (such as exposed fastener panels, concealed fastener panels, standing seam panels and the like). The second panelized section 22 is then formed, lifted into place with the lifting assembly 12 and then the second panelized section 22 is attached to the first panelized section 22, with the aligned edges of the two panelized sections 22 in overlapping or other joined relation, and to the frame 24 of the building 20. This process repeated until the entire wall 26 or roof 28, or desired portions thereof, are covered with panels 18 (via the panelized sections 22). For purposes of describing the various attributes and benefits of the present invention, each panelized section 22 has a first or leading side 60 (which is the side that is in the cladding/sheeting direction), a second or trailing side 62, a first or upper end 64 (with upward being the upper edge of a wall panel and the up-slope edge of a roof panel), a second or lower end 66, an outward or upper surface 68 and an inward or lower surface 70 (with the terms "outward or upper" and "inward or lower" having the same meaning as set forth above), as shown in FIGS. 2 and 3. The panelized section 22 shown in FIG. 2 comprises four panels 18, shown as first panel 18*a*, second panel 18*b*, third panel 18*c* and fourth panel 18*d*, that have been joined together utilizing the new panelizing assembly 10 and lifted into place with the lifting assembly 12 with the trailing edge 62 of the panelized sections 22 of the wall 26 and roof 28 at the edge of the building 20 and the leading edge 60 in the direction in which the cladding process will proceed. As will be readily appreciated by persons who are skilled in the art, the next panelized section 22 will be positioned such that the trailing edge 62 thereof will overlap or otherwise connect, as specified by the manufacturer of the panels 18, with the leading edge 60 (i.e., the fourth panel 18*d*) of the panelized section 22 already in place on the building 20. As will also be readily appreciated by persons skilled in the art, the panelizing assembly 10 and lifting assembly 12 are configured for use with virtually any panel profile 47 such that use of the new panelizing assembly 10 and lifting assembly 12 to install the cladding on the walls 26 and roof 28 of a building 20 can be accomplished with any configuration, type or style of the panel profile 47 of the panel 18.

The panelizing assembly 10, shown in FIGS. 3-6 and 8-11, generally comprises a support frame 72 and one or more panel alignment structures 74 that are cooperatively structured and arranged to support the panelizing assembly 10 on a surface 76 and allow the user to easily, quickly and accurately panelize a plurality of panels 18 into a panelized section 22. In the embodiment shown in the figures, the panelizing assembly 10 has three panel alignment structures 74, shown as first panel alignment structure 74*a*, second panel alignment structure 74*b* and third panel alignment structure 74*c*, as best shown in FIGS. 5-6, 8 and 10. The support frame 72 supports the panel alignment structures 74 on the surface 76 in a manner that allows the user to accurately position a plurality panels 18 on the panel alignment structures 74, place adjacent panels 18 together for panelized section 22 and then attach the lifting assembly 12 to form the panelized section 22 and to allow the panelized section 22 to be lifted into place against the frame 24 of the building 20 to form the wall 26 or roof 28 thereof. As set forth in more detail below, the panel alignment structures 74 are structured and arranged to allow the user to easily, quickly and accurately position the panels 18 next to each other, with adjacent panels 18 in overlapping or other alignment relationship, so the user can connect the adjacent panels 18 together in a manner which is appropriate for the type of panels 18 (i.e., whether exposed fastener panels, concealed fastener panels, standing seam panels or the like) to form the panelized section 22.

Figure 10:
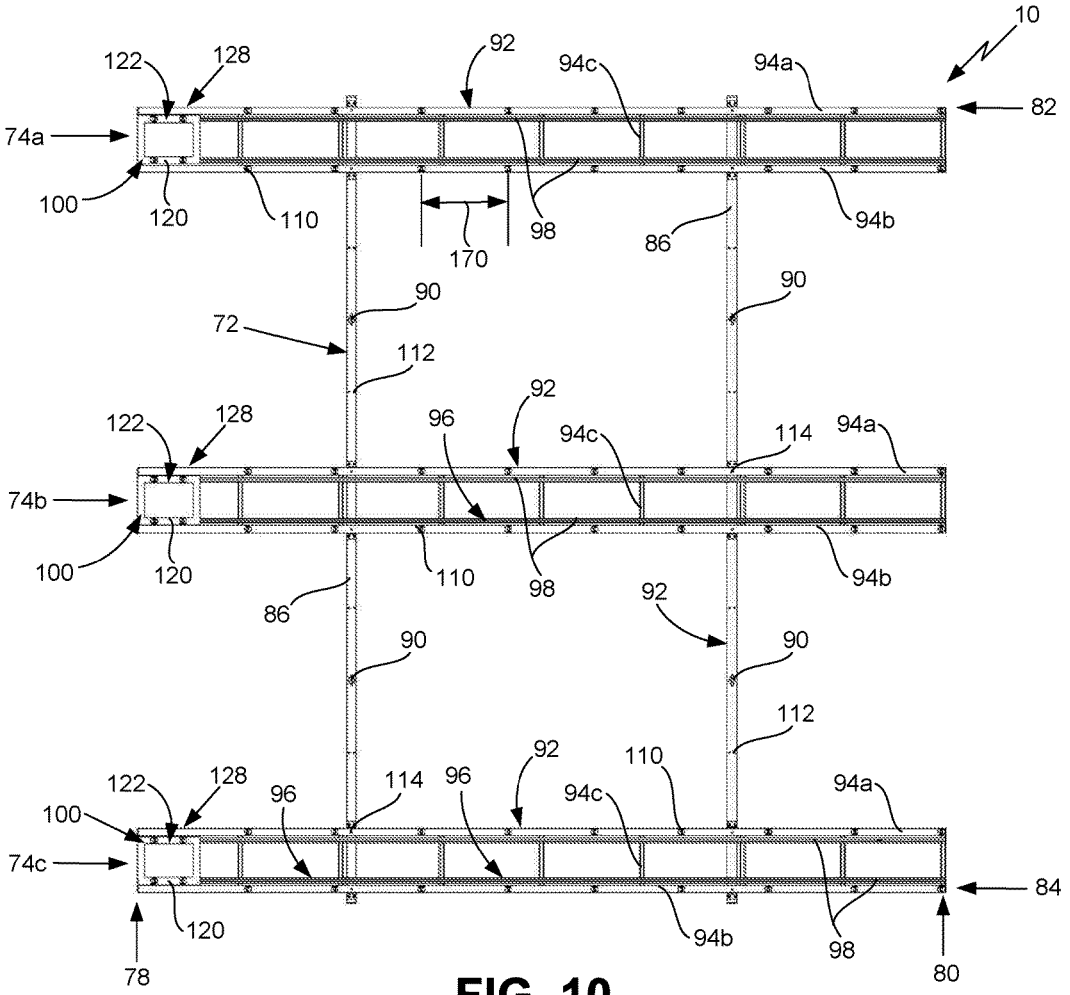
FIG. 10 is a top view of the panelizing assembly of FIG. 8.

Together, the support frame 72 and panel alignment structures 74 define a first side 78, second side 80, first end 82 and second end 84 of the new panelizing assembly 10, as best shown in FIG. 10. When panels 18 and a panelized section 22 are on the panelizing assembly 10, the sides 78/80 thereof correspond to the position of the sides 32/34 of the panels 18 and the sides 60/62 of the panelized section 22. As set forth in more detail below, the panels 18 are placed side by side in a cooperatively engaging manner, depending on the panel profile 49 and the manufacturer's recommended panel connecting mechanism, parallel to the sides 78/80 of the support frame 72 to form the panelized section 22. As also set forth in more detail below, the support frame 72 and panel alignment structures 74 are cooperatively sized and configured to allow the user to easily, quickly and accurately position the panels 18 and place the panels 18 together and then use the lifting assembly 12 to form the panelized section 22.

The support frame 72 comprises one or more support frame members 86 that are sized and configured to support the panel alignment structures 74, panels 18 and a panelized section 22, as shown in FIG. 3. In addition, as set forth below, the support frame members 86 preferably define a support frame 72 that can support the weight of one or more users on the panel alignment structures 74 (as a result of walking on the lifting assembly 12, as set forth below). The support frame members 86 must be sufficiently stiff and positioned relative to the various panel alignment structures 74 to keep the panel alignment structures 74 in a true, square and consistent manner to be able to form multiple panelized sections 22 that are uniform from one panelized section 22 to another 22 so each of the panelized sections 22 will cooperatively attach to each other and the frame 24 of the building 20 when forming a wall 26 or roof 28. In the figures, the support frame 72 has two steel I-beam support frame members 86 that are each shown as being transversely positioned relative to the panel alignment structures 74 so as to be aligned along the length of a panel 18 between ends 36/38 and the ends 64/66 of the panelized section 22. As will be readily appreciated by persons who are skilled in the art, support frame 72 may comprise one or more support frame members 86, the various support frame members 86 may be at angles other than right angles relative to the panel alignment structures 74, the support frame members 86 may be dimensionally varied (i.e., have different sizes, lengths and cross-sections) and be made out of a wide variety of different types of materials, including metals, composites and the like. Importantly, however, the support frame members 86 must be selected to provide a support frame 72 that is strong enough to support the weight of the items and people on the surface 76 and not flex, bend or otherwise alter its shape in light of such loads. In addition to the above, the support frame members 86 should be sufficiently strong and stiff to allow the support frame 72 to be moved to or at a job site using a forklift, crane or other moving machine without causing the support frame 72, as well as the panel alignment structures 74, to flex, bend or otherwise become unaligned such that it would not be able to produce true, square and consistent panelized sections 22.

Figure 8:
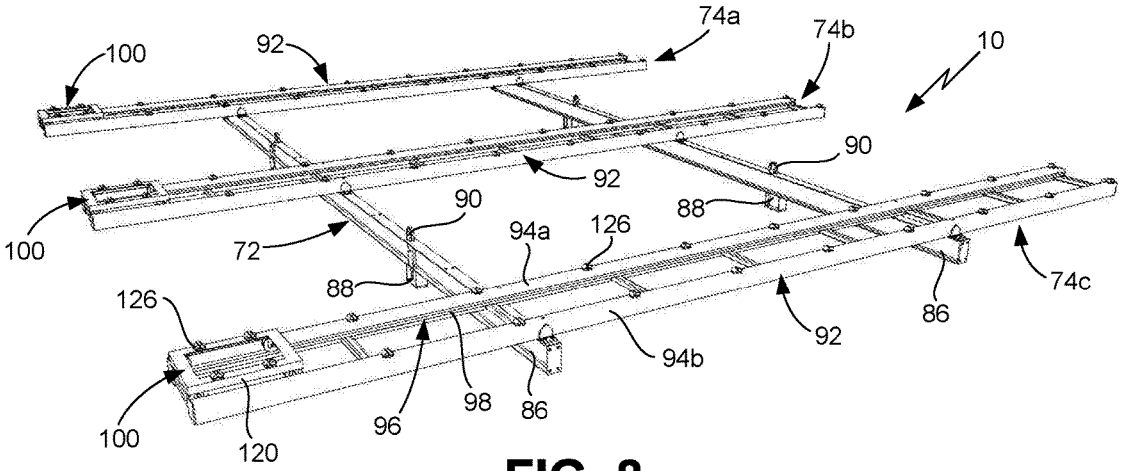
FIG. 8 is a side perspective view of the panelizing assembly of FIG. 5 shown without the lifting assembly.
Figure 9:
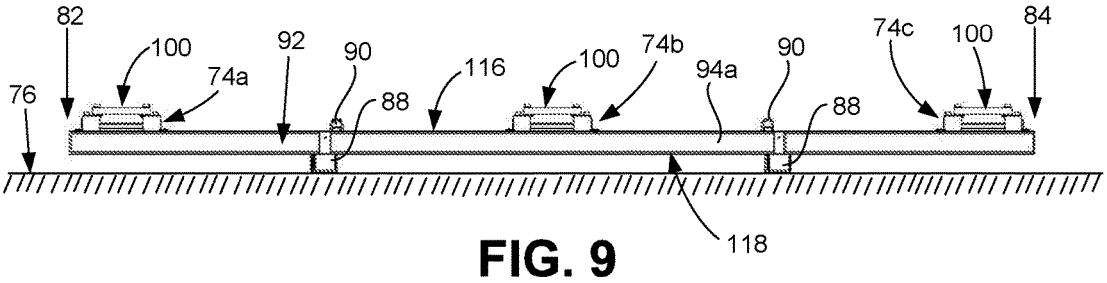
FIG. 9 is a side view of the panelizing assembly of FIG. 8.
Figure 11:
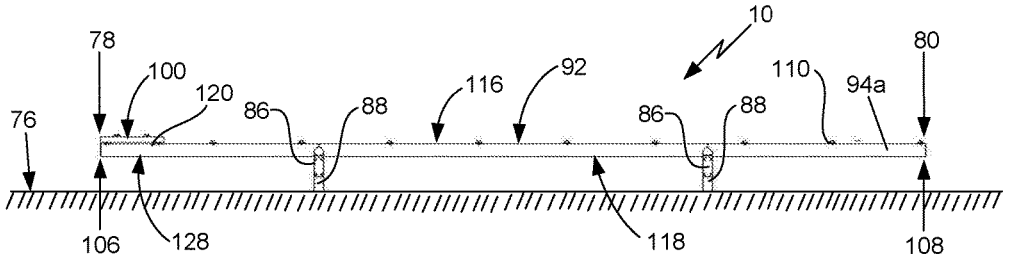
FIG. 11 is a front view of the panelizing assembly of FIG. 8.

To accomplish the various desired objectives of the present invention, a preferred configuration of the support frame 72 has a plurality of surface support members 88 that are attached to or integral with the lower surface 89 of support frame 72, which in the embodiments shown in the figures, is the lower of the support frame members 86, so as to extend downwardly therefrom (i.e., towards the surface 76), as best shown in FIGS. 8-9 and 11. The surface support members are sized and configured to support the support frame 72 in spaced apart relation above the surface 76, which may be the ground at a job site, a foundation or other surface that is at or near the building 20 to which the panelized sections 22 will be attached or the bed of a truck or trailer on which the panelizing assembly 10 is transported. The surface support members 88, which are utilized as "feet" for the panelizing assembly 10, should position the lower surface 89 of the support frame 72 sufficiently above the surface 76 so the tines of a fork lift or the like can be positioned under the support frame 72 to move the panelizing assembly 10. In the embodiment shown in the figures, the surface support members 88 are integral or attached to the lower surface of the support frame members 86, as best shown in FIGS. 8-9 and 11. In other embodiments, the surface support members 88 may be integral or attached to other components of the support frame 72. A wide variety of different sized and configured components can be utilized for surface support members 88, which may be fixedly or removably attached by welding, rivets or the like or utilizing bolts, screws and the like, the selection of which is likely to depend on the configuration of and materials utilized for the support frame members 86 of the support frame 72.

The support frame 72 of the panelizing assembly 10 of the present invention also has one or more, preferably a plurality of, frame lifting devices 90 (shown in FIGS. 8-11) that are sized and configured to connect to a moving machine, such as a forklift, crane or the like (not shown) so the moving machine can be used to move the panelizing assembly 10. The frame lifting devices 90 are utilized to lift the panelizing assembly 10 and easily move it to or around a job site. In one embodiment, each of the frame lifting devices 90 are sized and configured to removably connect a cable or the like from a forklift, crane or other moving machine to the support frame 72 so the panelizing assembly 10 can be easily and quickly moved on the job site by the moving machine to place the panelizing assembly 10 closer to the location on the building 20 where the panelized section 22 will be installed. The frame lifting devices 90 can be lifting lugs, eye-bolts or like devices which are attached to or integral with the upper surface 91 of the support frame 72, namely the upper surface of one or more of the support frame members 86, as best shown in FIGS. 8-11. In one use, a plurality of cables will be connected to the moving machine and the frame lifting devices 90 will have an open area that is sized and configured to allow the user to attach a clip or other connector at the end of one of the cables to one of the frame lifting devices 90 so the moving machine can lift support frame 72, and therefore the panelizing assembly 10, with the cables to move the panelizing assembly 10 to where it is beneficially desired to be located. A wide variety of alternatively configured frame lifting devices 90 and other types of moving mechanism systems can be utilized to connect to the support frame 72 to allow the user to move the panelizing assembly 10.

As set forth above, the new panelizing assembly 10 has one or more panel alignment structures 74 that are structurally associated with the support frame 72 such that the support frame 72 supports the panel alignment structures 74 above the surface 76, as shown in FIGS. 9 and 11. Each panel alignment structure 74, which is best shown in FIGS. 7-14, generally comprises an elongated alignment frame 92 having a plurality of frame members 94, rail track 96 having one or more rail members 98 supported by the alignment frame 92, a panel cart 100 having one or more rail engagement devices 102 that moveably engage the rail members 98 to allow the panel cart 100 to move along the rail track 96, a cart stop member 104 at each of the opposing ends 106/108 of the alignment frame 92 to stop the panel cart 100 and a plurality of panel positioning devices 110 on the alignment frame 92 and panel cart 100 that are each sized and configured to assist the user with properly positioning the plurality of panels 18 on the panelizing assembly 10 so he or she may easily, quickly and accurately form the panelized section 22.

As best shown in FIGS. 10-11, the elongated alignment frame 92 extends between the first side 78 of the support frame 72 and the second side 74 thereof. As set forth above, the alignment frame 92 comprises a plurality of frame members 94 that define the shape and size of the alignment frame 92. In the embodiment shown in the figures, the alignment frame 92 has a first longitudinal frame member 94*a*, a second longitudinal frame member 94*b* and a plurality of transverse frame members 94*c*. Each of the transverse frame members 94*c* are sized and configured to interconnect the two longitudinal frame members 94*a*/94*b* so as to maintain the longitudinal frame members 94*a*/94*b* in spaced apart relation with the two longitudinal frame members 94*a*/94*b* being parallel to each other so as to define a ladder-shaped structure, as best shown in FIGS. 8 and 10. The alignment frame 92 is integral with or attached to the support frame members 86 so as to position, fixedly or moveably, the panel alignment structure 74 on the support frame 72. More specifically, in the embodiment shown in the figures, the longitudinal frame members 94*a*/94*b* are integral with or attached to the upper surface 92 of the support frame 72 (which, in the present embodiment, is defined by the upper surface of the support frame members 86), as shown in FIGS. 3, 5-6 and 8-11. The components of the alignment frame 92 can be made out of a wide variety of different sizes, configurations and materials. As set forth in more detail below, however, the alignment frame 92 must be structured and arranged to support the full transitional load of a bundle of panels 19 as it moves, on the panel cart 100, from the first side 78 to the second side 80 of the support frame 72.

Although the alignment frame 92 may be integral with the support frame 72 or fixedly attached to the support frame 72, by welding, rivets or other appropriate mechanisms, in the preferred embodiment the alignment frame 92 is removably attached to the support frame 72 to allow the user to separate the panel alignment structure 94 from the support frame 72 for ease of moving and storing the panelizing assembly 10 and to allow the user to adjust spacing between the panel alignment structures 94 to accommodate different lengths of panels 18 and for two-tone color transitions and/or the locations of skylights and/or other wall or roof accessories. In one configuration, the support frame 72 and each of the panel alignment structures 74 have a plurality of cooperatively configured and arranged frame mounting apertures, shown as 112 on the support frame 72 and as 114 on the panel alignment structures 74 in FIG. 10. In one embodiment, the frame mounting apertures 112 are on the upper surface 91 of the support frame 72 and through the longitudinal frame members 94*a*/94*b* of the alignment frame 92 so as to pass through from the upper surface 116 of the alignment frame 92 to the lower surface 118 of the alignment frame 92, which is placed against the upper surface 91 of the support frame 72. As shown in the figures, the upper surface 116 of the alignment frames 92 defines the upper surface of the panel alignment structures 74 and the panelizing assembly 10, on which panels 18 are placed and the panelized section 22 is formed, and the lower surface 118 defines the lower surface 74 of the panel alignment structures 74, which is placed on the support frame 72, as best shown in FIGS. 9-11. Using the mounting apertures 112/114 and bolts, screws or like devices, the user can selectively position the alignment frame 92 on the support frame 72 to best accommodate the length (i.e., first end 36 to second end 38) of the panels 18. As will be readily appreciated by persons skilled in the art, a wide variety of different mechanisms can be utilized for panelizing assembly 10 to removably mount the panel alignment structure 74 on the support frame 72.

Figure 12:
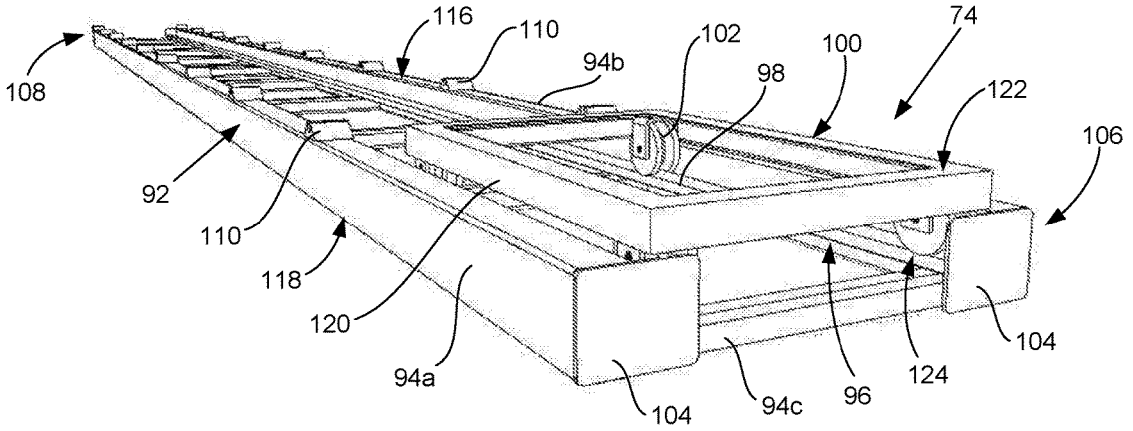
FIG. 12 is a side perspective view of one of the alignment structure of the panelizing assembly of FIG. 8.
Figure 13:
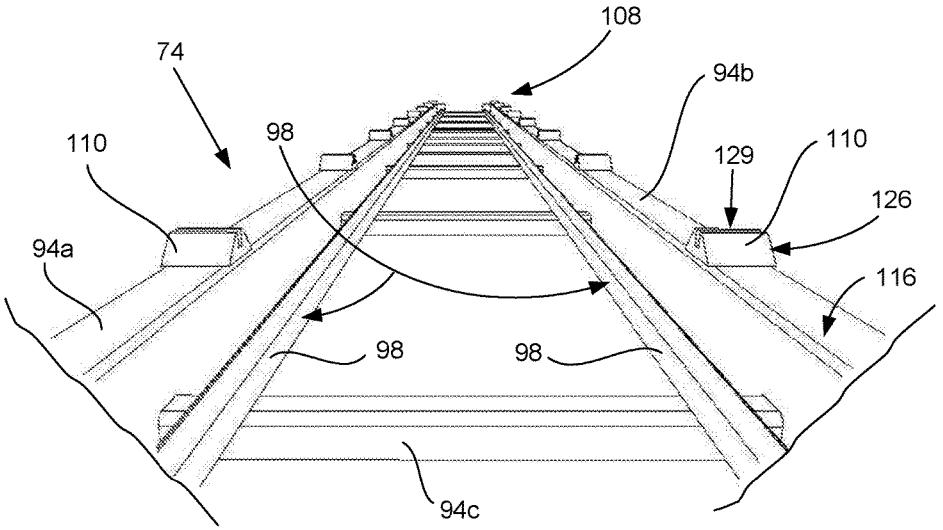
FIG. 13 is a front view of the alignment structure of FIG. 12 shown without the panel cart.

As set forth above, each of the panel alignment structures 74 have a rail track 96 that is attached to, integral with or otherwise supportedly associated with the alignment frame 92, as best shown in FIGS. 7-8, 10 and 12-13. In the embodiment shown in the figures, the rail track 96 comprises a pair of parallel, spaced apart rail members 98 that are cooperatively sized and configured in corresponding relation with the rail engagement devices 102 of the panel cart 100. The rail track 96 and rail engagement devices are configured to allow the panel cart 100, having a plurality of panels 18 (i.e., a bundle of panels 19) thereon, to move across the support frame 72 from the first side 78 to the second side 80 thereof. Movement of the panel cart 100 and panels 18 thereon will allow the user to remove a single panel 18 from the bundle of panels 19 on the panel cart 100 and place that panel 18 in position on the alignment frame 92 to form a panelized section 22. In one configuration, the rail members 98 are integrally formed or fixedly attached to the respective transverse frame members 94*c*, as best shown in FIGS. 12-13, so the rail members 98 can be easily moved, stored, installed and then utilized with the alignment frame 92.

Figure 7:
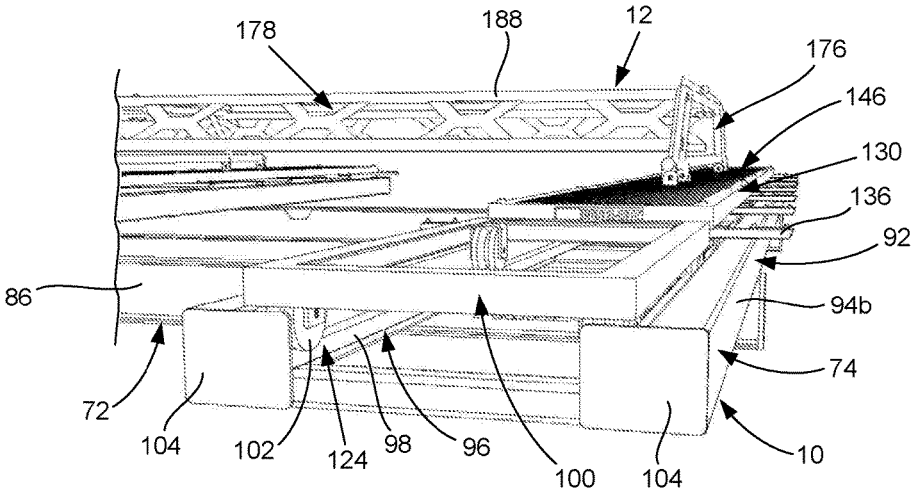
FIG. 7 is an isolated front perspective view of the right side of the panelizing and lifting apparatus of FIG. 6 to better illustrate components thereof.

The panel cart 100, which moves along the rail track 96, has a panel cart frame 120 that is sized and configured to receive a bundle of panels 19 on the upper surface 122 thereof, with the panel frame 120 and upper surface 122 best shown in FIGS. 10 and 12. In the embodiment shown in the figures, the rail engagement devices 102 are grooved wheels that are rotatably attached to the panel cart frame 120 and are cooperatively sized and configured to moveably engage (i.e., roll along) the rail members 98 that define the rail track 96, as best shown in FIGS. 7 and 12. As will be readily appreciated by persons who are skilled in the relevant art, a wide variety moving mechanisms 124 can be utilized with the panel alignment structure 74 to allow the panel cart 100 to move along alignment frame 92 so that panels 18 can be removed from the panel cart 100 and place in position on the alignment frame 92 (with the moving mechanism 124 shown in the figures, particularly FIGS. 7 and 12, comprising rail track 96 and the cooperatively configured rail engagement devices 102). For instance, moving mechanism 124 can comprise the rail engagement devices 102 being rollers or the like that are attached to or otherwise associated with the panel cart frame 120 so as to rotatably move inside a channel in the panel alignment structure 74 of the present invention to allow the panel cart 100 to move along the alignment frame 92. Alternatively, the moving mechanism 124 can comprise a chain or belt drive system, magnetic levitation system and the like. As will be readily appreciated by persons who install panels 18 on buildings 20, it is preferred that any such moving mechanism 124 be suitable for reliable use in a typical outdoor, construction environment and that the moving mechanism 124 be configured to allow a heavily loaded panel cart 100 to relatively easily move along the length, in unison, of each of the panel alignment structures 94*a*/94*b*/94*c*.

In a preferred embodiment of the panelizing assembly 10, the panel alignment structures 74 have cart stop members 104 at each of the opposing ends 106/108 of the alignment frame 92 to prevent the panel cart 100 from going beyond the ends 106/108 of the alignment frame 92, which are at the sides 78/80 of the support frame 72, as shown in FIGS. 11-12. In the embodiment shown in the figures, the cart stop members 104 are relatively small plates that are attached to and extend slightly, but sufficiently, above the upper surface 116 of the alignment frame 92 so as to engage (i.e., stop) further movement of the rail engagement devices 102 and, as such, the panel cart 100. As will be readily appreciated by persons skilled in the art, a wide variety of different devices and mechanisms can be utilized as the cart stop members 104.

Figure 14:
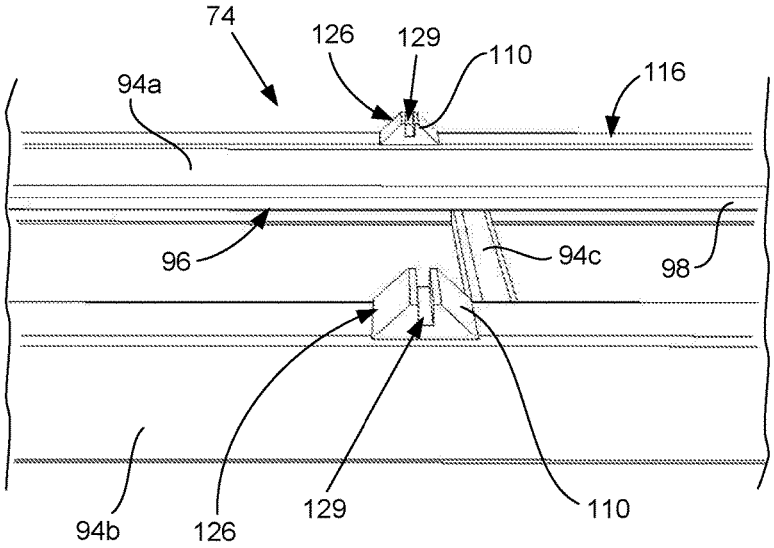
FIG. 14 is an isolated side view of the alignment structure particularly showing a pair of panel positioning devices thereon.

To allow the user to easily, quickly and accurately align the panels 18 into the desired panelized section 22, the panelizing assembly 10 also includes a plurality of panel positioning devices 110 on the panel alignment structures 74 and, in a preferred embodiment, the panel cart 100, as shown in FIGS. 8-13. Each of the panel position members 110 are sized and configured in corresponding relation to the panel profile 47 of the panels 18. More specifically, each of the panel position members 110 have a device profile 126, as best shown in FIGS. 13-14, that is correspondingly sized and configured with the panel profile 47 of the panels 18 such that when a panel 18 is placed on the upper surface 116 of the alignment frame 92, as shown in FIG. 3, the panel 18 will essentially "lock" in place on the panel alignment structure 74 and, as a result, the panelizing assembly 10. With regard to the panel positioning devices 110 that are placed on the panel alignment structures 74, the device profile 126 of the panel positioning devices 110 is selected such that when a panel 18 is positioned on the panel alignment structure 74 the panel positioning device 110 will engage the panel 18 to hold the panel 18 in place so the next panel 18 can then be placed in overlapping or other connecting relation with the previously placed panel 18 so the user can easily and accurately connect two panels 18 together (as is appropriate for the particular type of panel 18) and, when all the necessary panels 18 are in place, form the panelized section 22. In the figures, the panel positioning devices 110 are block-shaped members having the device profile 126. In an alternative embodiment, the panel positioning devices can be pattern cut dies that are integral with or attached to the alignment frame 92 and which have the device profile 126. As will be readily appreciated by persons skilled in the art, a variety of other devices, members, assemblies and the like can be utilized for the panel positioning devices 110.

With regard to the exemplary corrugated panel 18 shown in FIGS. 1-3 having a panel profile 47 with the particular ribs 44 and valleys 46 combination (as best shown in FIG. 1), the device profile 126 of each of the panel positioning devices 110 are sized and configured to be received in the ribs 44 of the panel 18. The device profile 126 of FIG. 14 is sized and shaped in corresponding relation with the panel profile 47 of the panel 18 shown in FIG. 1.

In a preferred configuration, the placement of the panel positioning devices 110 is such that the spacing between adjacent panel positioning devices 110 will result in each panel 18 being engaged by two or more panel positioning devices 110 on the same panel alignment structure 74 to ensure that the panels 18 stay properly aligned. In addition, each of the panel alignment structures 74 will have panel positioning devices 110 that are aligned with the panel positioning devices 110 on the other panel alignment structures 74. More specifically, the panel alignment structures 74 are cooperatively configured such that the panel positioning devices 110 of each panel alignment structure 74 are aligned with the panel positioning devices 110 of the other panel alignment structures 74. For instance, with regard to the exemplary panelizing assembly 10 shown in the figures, the panel positioning devices 110 on the panel alignment structures 74*a*/74*b*/74*c* are positioned at the same location along the length of the longitudinal frame members 94*a*/94*b* of the alignment frame 92. With the panel positioning devices 110 aligned, the panel 18 will extend over the panel alignment structures 74*a*/74*b*/74*c* to engage the panel positioning devices 110 to align the entire length, from first end 36 to second end 38, of the panel 18 to ensure that the formed panelized section 22 is true, straight and accurate so that it can placed on the frame 24 of a building 20 and be joined to an adjacent panelized section 22 to form a wall 26 or the roof 28 of the building 20.

With regard to the panel alignment structures 74, the panel positioning devices 110 are integral with or attached to the upper surface 116 of the alignment frame 92. In one embodiment, the panel positioning devices 110 are integral or fixedly attached to the longitudinal frame members 94*a*/94*b* of the alignment frame 92 such that the panel alignment structures 74 are to be utilized with a particular configuration of panel 18 having a panel profile 47. Although limiting, this type of configuration may work well for persons who primarily install one or only a few different types of panels 18. In a preferred embodiment, however, each panel positioning device 110 is removably, but securely, attached to the alignment frame 92 (normally the longitudinal frame members 94*a*/94*b* thereof) so the user may have a single set of panel alignment structures 74 and be able to replace the panel positioning devices 110 as necessary for the device profile 126 to be the same as the panel profile 47 of the panels 18. In a preferred configuration, bolts, screws or other such connectors are utilized to removably attach the panel positioning devices 110 to the longitudinal frame members 94*a*/94*b* of alignment frame 92 of each of the panel alignment structures 74 that make up panelizing assembly 10.

As shown in the figures, the panel positioning devices 110 are configured in pairs such that the first longitudinal frame member 94*a* and the second longitudinal frame member 94*b* of an alignment frame 92 will each have a correspondingly positioned panel positioning device 110 and the panel positioning devices 110 on each of the alignment frames 92 that make up support frame 72 will also be correspondingly positioned so the panel positioning devices 110 are transversely aligned across the panel lifting apparatus 10. This will ensure that each panel 18 is aligned with the other panels 18 that are placed on the panel alignment structures 74 when forming a panelized section 22.

In the embodiment shown in the figures, panel positioning devices 110 are also utilized on the panel cart 110, as shown in FIGS. 8-11. As set forth above, a bundle of panels 19 is positioned on the panel cart 110 and the panel cart 110 is utilized to move the bundle of panels 19 from the first end 106 to the second end 108 of the alignment frame 92 (which also moves the bundle of panels 19 from the first side 78 to the second side 80 of the support frame 72) so a single panel 18 (i.e., first panel 18*a*) can be removed from the bundle of panels 19 and placed on the panel positioning devices 110 and alignment frame 92 at the second side 80 of the support structure 72 to form the first/leading side 60 of the panelized section 22. As the panel cart 100 is rolled back toward the first side 78 of the support structure 72 to the panel cart area 128 where the panel cart 100 is stored when the panel cart 100 is not in use to move the bundle of panels 19, each subsequent panel 18 (i.e., panels 18*b*, 18*c* and 18*d*) is removed from the bundle of panels 19 on the panel cart 100 and placed on the panel alignment structures 74 until all of the panels 18 that make up the panelized section 22 are in place on the panelizing assembly 10. In the embodiment shown in the figures, the panel cart area 128 is a portion of the panel alignment structures 74 toward the first side 78 of the support frame 72 that is in spaced apart relation to the second/trailing side 62 of where the panelized section 22 will be located, as shown in FIGS. 3 and 5-6 and 10-11. Use of panel positioning devices 110 on the upper surface 122 of the panel cart frame 120 will help hold the bundle of panels 19 in place and reduce the likelihood that any panels 18 will be damaged during the process of placing the panels 18 on the panel alignment structures 74.

As will be readily appreciated by persons who are skilled in the art, the panel positioning devices 110 can be made out of a wide variety of different types of material, including metal, plastic, composite, rubber and the like. If the panel positioning devices 110 are integral to the alignment frame 92, it is likely that the panel positioning devices 110 will be made out of metal. In practice, however, the use of metal panel positioning devices 110 have been found to dent the panels 18. In a preferred embodiment, the panel positioning devices 110 are made of a material that is selected so it will not damage the panels 18 when they are placed on the panel alignment structures 74 or the panel cart 100. In one embodiment, the panel positioning devices 110 are made out of polyurethane or the like, with the panel positioning device 110 being shaped and configured to the desired device profile 126 (i.e., in corresponding relation with the panel profile 47 of the panels 18 that will make up the panelized section 22).

In a preferred embodiment, the panel positioning devices 110 are also configured to assist the user with connecting two adjacent panels 18 together in the manner suggested by the manufacturer of the panels 18 or as otherwise may be desired. A common manner of connecting the first side 32 of one panel 18 to the second side 34 of the previously positioned panel 18 (i.e., the first side 32 of panel 18*b* to the second side 34 of panel 18*a*) is to drive a self-drilling screw or other connector through the overlapping or otherwise joining portion, shown as 164 in FIG. 26, of the two panels 18*a*/18*b* (a common way of connecting corrugated panels). The connector will penetrate the two panels 18*a*/18*b* and hold them together to form the panelized section 22. To avoid damage to the panel positioning device 110, the preferred configuration for the panel positioning is to have an open area 129, as best shown in FIGS. 13-14, in which the first end of the connector is allowed to enter in a manner that avoids contacting or connecting to the body of the panel positioning device 110. In the embodiment shown in the figures, the open area 129 is a slot in the panel positioning device 110 that is at the center of the panel positioning device 110 and extends downward a sufficient distance to avoid being hit by the connector utilized to join two panels together (i.e., panel 18*b* to panel 18*a*). As will be readily appreciated by persons who are skilled in the art, the open area 129 can be round, oval, square or a wide variety of other shapes (i.e., not necessarily a rectangular slot as shown in the figures). Other types of mechanisms for connecting a second panel (i.e., 18*b*) to a previously positioned panel (i.e., first panel 18*a*) may require or benefit from different configurations of the panel positioning device 110 that take into account any features of the mechanism which will need to be received or supported by the panel positioning device 110.

As set forth above, the present invention also includes a panel lifting assembly 12 that is structured and arranged to engage the panelized section 22 formed by the panelizing assembly 10 described above. Typically, the new lifting assembly 12 will be placed in position against the panelized section 22 (as shown in FIG. 3, by aerial lifting machine (such as a crane, boom truck, reach lift forklift or the like) and then manually attached to the panelized section 22. The aerial lifting machine lifts the lifting assembly 12 and the panelized section 22 that is secured thereto off of the panelizing assembly 10, and positions the panelized section 22 in place against the frame 24 of a building 20 to form the walls 26 or roof 28 of the building 28, as shown in FIG. 2. Once in place, the panelized section 22 will be attached to the frame 24, primarily the girts 48 and purlins 50, and then the lifting assembly 12 will be disconnected from the panelized section 22 and lowered back toward the panelizing assembly 10 by the aerial lifting machine and then placed into position against the next panelized section 22 (which will typically be formed while the previous panelized section 22 was being raised to and placed in position against the frame 24). As set forth in detail below, the system 14 and method 16 for panelizing and installing panels of the present invention utilize both the panelizing assembly 10 and the lifting assembly 12 to form panelized sections 22 and place the panelized sections 22 against the frame 24 of a building 20 to form the walls 26 and/or roof 28 thereof.

The lifting assembly 12 of the present invention generally comprises one or more, typically a plurality of, specially configured panel lifters 130 and a support lift structure 132, as shown in FIGS. 3, 5-6 and 15-18. The panel lifters 130 are structured and arranged to removably attach to the completed panelized section 22 while the panelized section 22 is on the panelizing assembly 10 and to hold the panelized section 22 together while the panelized section 22 is being lifted and moved into place against the frame 24 of the building 20 by the aerial lifting machine. The support lift structure 132, which is integral with or configured to be attached to the panel lifters 130 and to an aerial lifting machine, is structured and arranged to support the panel lifters 130 as the lifting assembly 12 and panelized section 22 are lifted and moved into position against the frame 24 of a building 20. As set forth in more detail below, the panel lifters 130 are structured and arranged to engage the panels 18 of the panelized section 22 based on the particular panel profile 47 of the panels 18.

Figure 15:
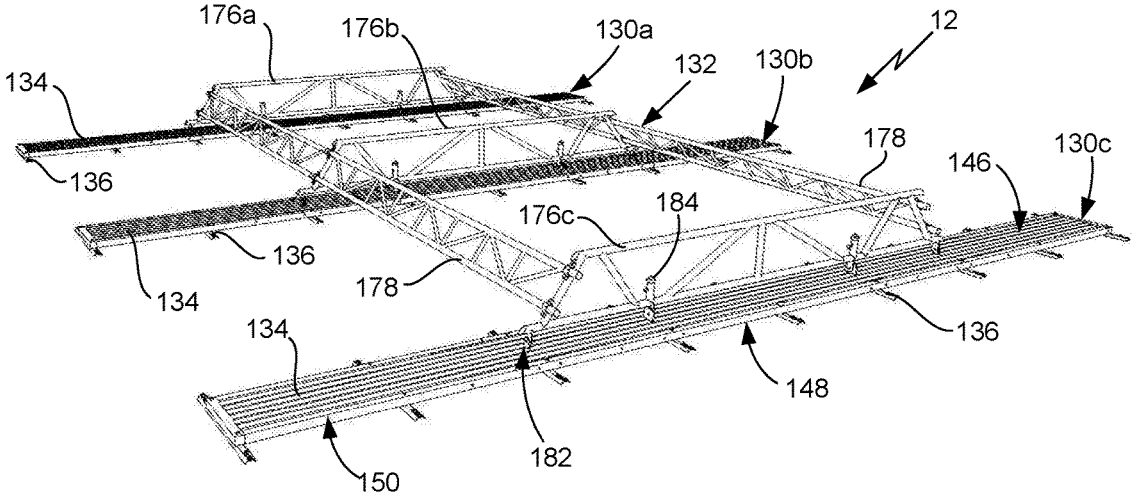
FIG. 15 is a side perspective view of the lifting assembly of FIG. 3 shown separate from the panelizing assembly.
Figure 16:
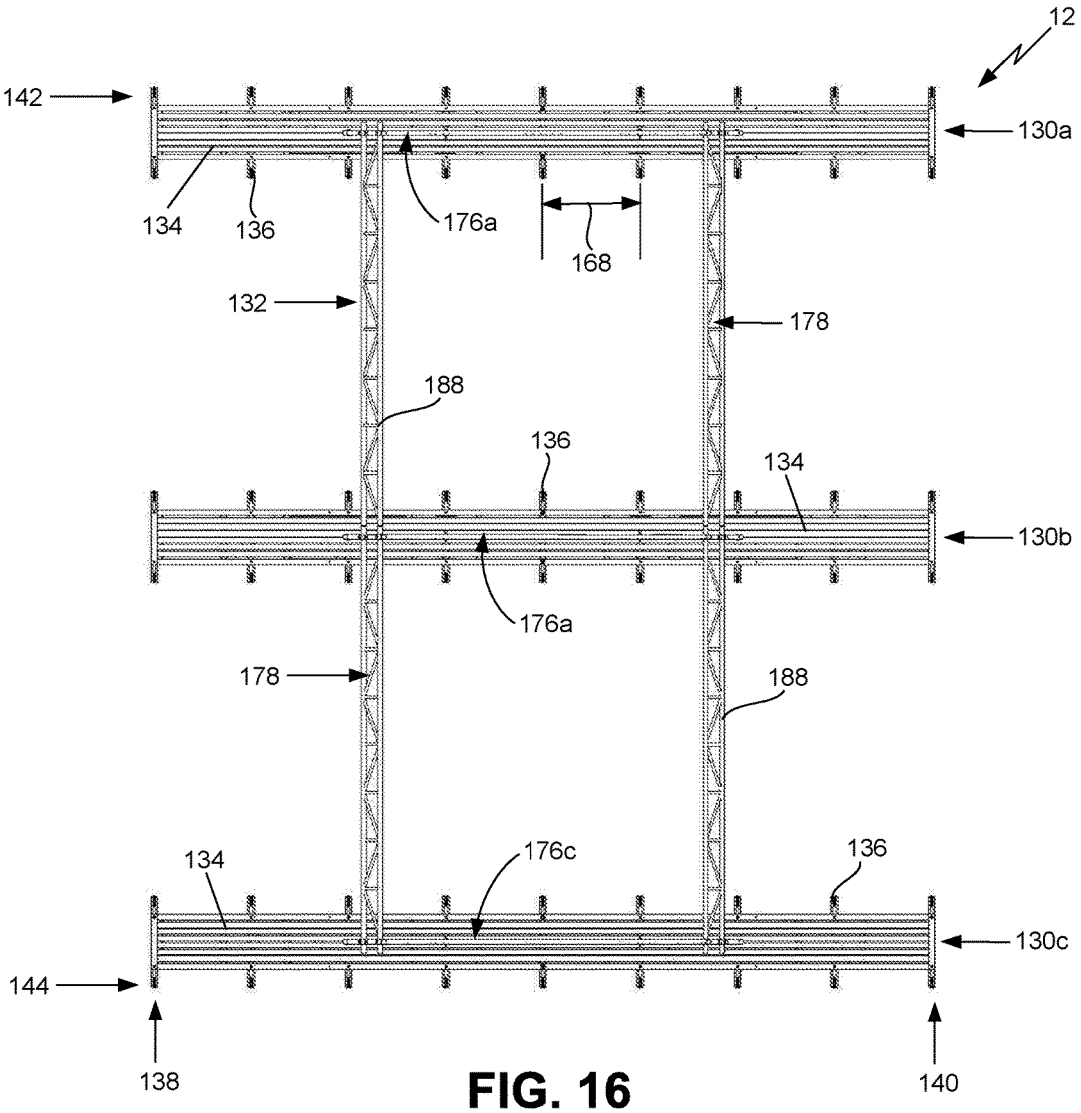
FIG. 16 is a top view of the lifting assembly of FIG. 15.
Figure 17:
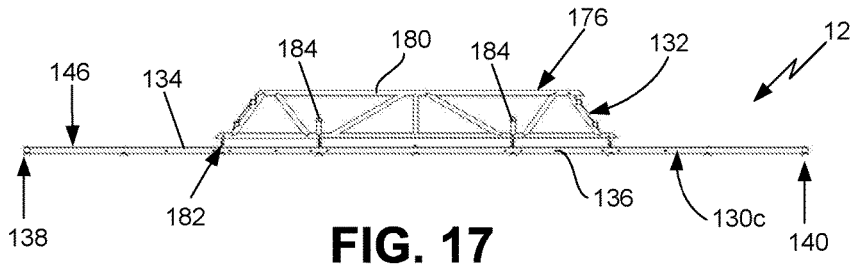
FIG. 17 is a front view of the lifting assembly of FIG. 15.
Figure 18:
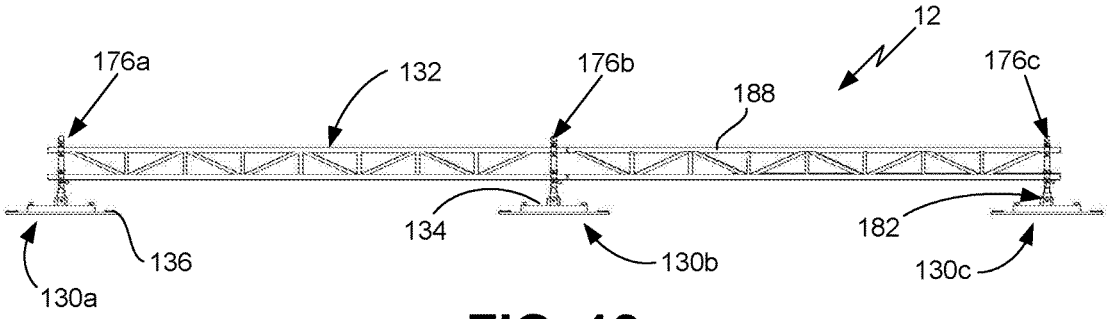
FIG. 18 is a side view of the lifting assembly of FIG. 15.
Figure 19:
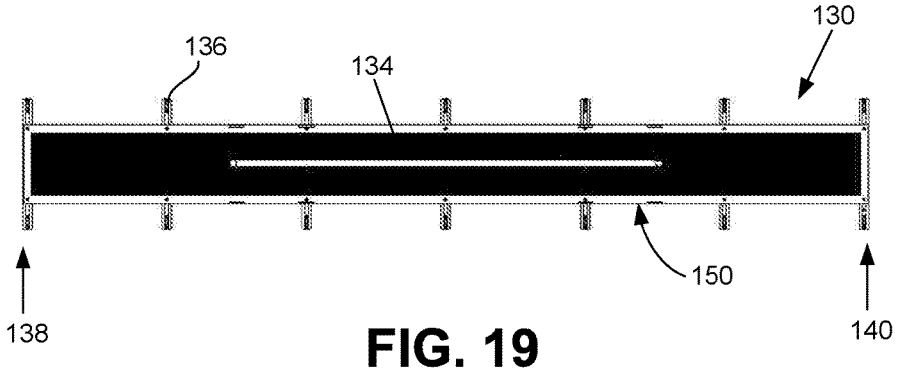
FIG. 19 is a top view of one of the panel lifters of the lifting assembly of FIG. 16.
Figure 20:
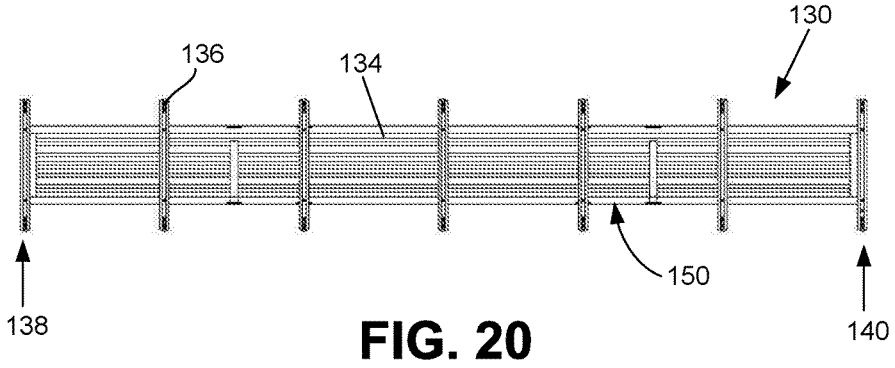
FIG. 20 is a bottom view of the panel lifter of FIG. 19.

In the embodiment shown in the figures, the lifting assembly 12 has three elongated panel lifters 130, shown in FIGS. 6 and 15-16 as first panel lifter 130*a*, second panel lifter 130*b* and third panel lifter 130*c*. In a preferred embodiment, each of the panel lifters 130 are configured the same or at least substantially the same so they may be interchangeably utilized for different panel installations. Each panel lifter 130 has a lifter frame 134 and one or more, typically a plurality of, cap members 136. As set forth in more detail below, each of the cap members 136 are attached to or integral with the lifter frame 134 and the cap members 136 are sized and configured and positioned relative to each other on the lifter frame 134 so as to be utilized for a particular panel profile 47 based on the panels 18 that were utilized to form the panelized section 22. The lifter frame 134 is structured and arranged to support the cap members 136 in the required positions relative to the panelized section 22 and, in a preferred embodiment, to allow the users to walk thereon to attach adjacent panels 18 together to form a panelized section 22 and to connect the various cap members 136 to the panelized section 22. The lifting assembly 12 has a first side 138, a second side 140, a first end 142 and a second end 144, as best shown in FIGS. 16-18, that correspond to the sides 78/80 and ends 82/84 of the support frame 72 of the panelizing assembly 10. In the embodiment shown in figures, the sides 138/140 and ends 142/144 of the lifting assembly 12 are defined by the three panel lifters 130*a*/130*b*/130*c*, as best shown in FIG. 16.

The lifter frame 134 of each panel lifter 130 is structured and arranged to extend substantially between the first side 60 and the second side 62 of the panelized section 22, as best shown in FIG. 3, to support a cap member 136 at each side 138/140 of the lifting assembly 12, as shown in FIGS. 5-6 and 15-17. The lifter frame 134 defines an upper surface 146 and a lower surface 148 of the panel lifter 130, as best shown in FIGS. 17-18. The cap members 136 are positioned so as to extend downward below the lower surface 148 of the panel lifter 130 so they can engage the upper outward/upper surface 40 of the panel body 30 of the panels 18, as shown in FIGS. 3, 5-6 and 15-22, when the lifting assembly 12 is positioned against the panelized section 22. The support lift structure 132 is attached to or integral with the upper surface 146 of the panel lifter 130, as best shown in FIGS. 3, 5-6, 15-19 and 21. In one embodiment, the lifter frame 134 can be an elongated bar, tube, angle iron or the like to which the cap members 136 are integrally formed or attached thereto. In the embodiment shown in the figures, however, the lifter frame 134 is a rectangularly shaped platform 150 having a width that is sufficient for the user or users to walk on while he or she is connecting the lifting assembly 12 to the panelized section 22 prior to lifting the panelized section 22 to its place against the frame 24 of the building 20. The body of the platform 150 can be made out of aluminum or other relatively lightweight, stiff material, including various other metals or composites and the like, that are suitable for use as a walking surface. In one configuration of this embodiment, the upper surface 146 of panel lifter 130 is made from aluminum channel. In another configuration, the upper surface 146 of panel lifter 130, which can be a different material than the body of the platform 150, is made from a composite material similar to materials which are utilized for bleacher seats in a stadium. In yet other configurations, the material on the platform 150 for the upper surface 146 can be metal, plastics, composites, wood or other materials. Any material utilized for the platform 150 to form the upper surface 146 should be selected to be stiff enough for users to walk on but, preferably, not so heavy as to significantly add to the weight of the lifting assembly 12.

Figure 25:
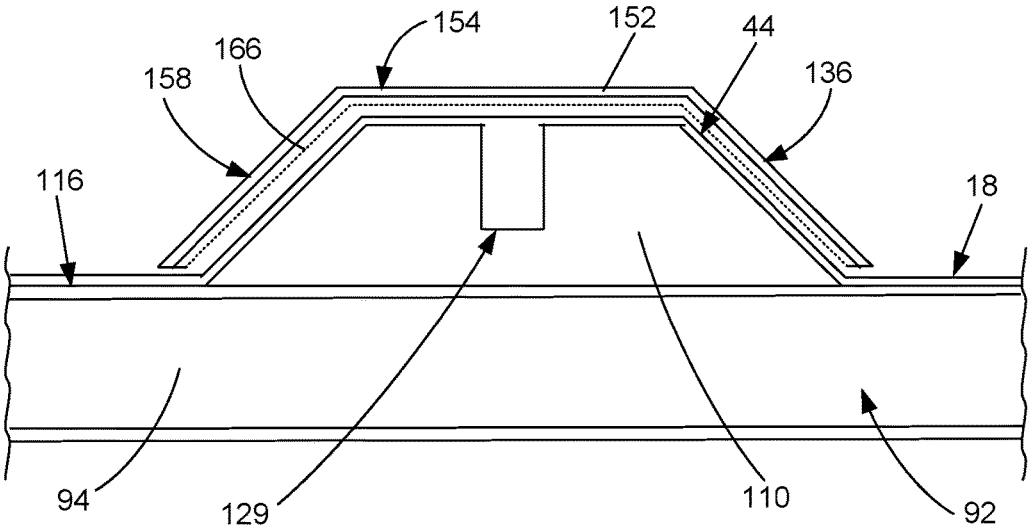
FIG. 25 is an end view of the cap member of FIG. 24 shown positioned over the rib of a panel and with a panel positioning device on a frame member of the alignment frame under the rib of the panel.
Figure 26:
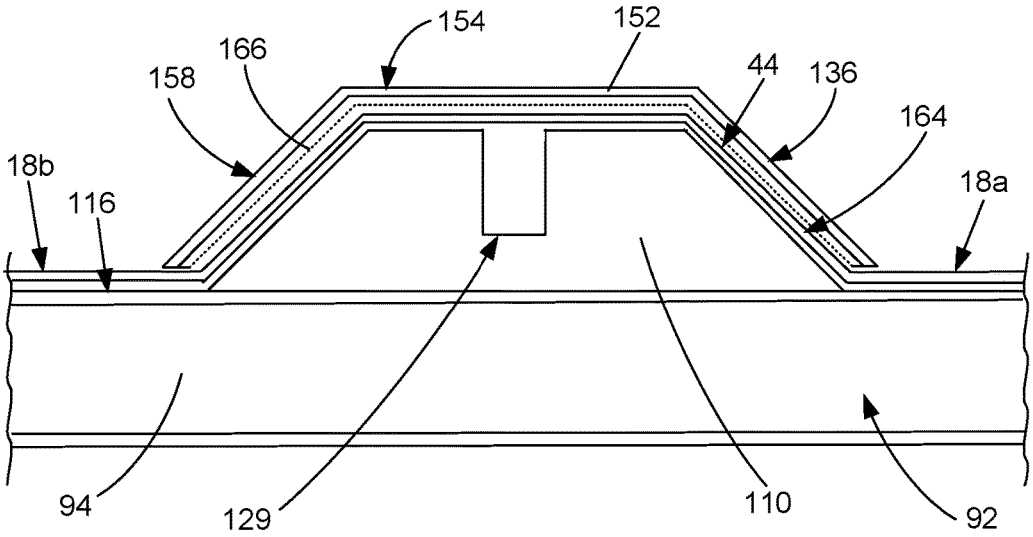
FIG. 26 is an end view of the cap member of FIG. 24 shown positioned over the ribs of the overlapping or other joining portion of adjacent panels and with a panel positioning device on a frame member of the alignment frame under the ribs of the two panels.

As set forth above, each panel lifter 130 of the lifting assembly 12 has a plurality of cap members 136 that are integral with or attached to the lifter frame 134 so as to extend below the lower surface 148 of the lifter frame 134 and engage the panelized section 22 on the panelizing assembly 10 so the panelized section 22 can be lifted into place against the frame 24 of a building 20. Each of the cap members 136 have a cap body 152, with a first end 154 and second end 156, that is sized and configured with a cap profile 158, as best shown in FIGS. 19-26, that is configured in corresponding relation to the panel profile 47 of the panels 18 such that the cap body 152 can be placed in abutting engagement with a portion of the panels 18 of the panelized section 22, as shown in FIGS. 25-26. The cap body 152 has an upper surface 160 and a lower surface 162, with the cap profile 158 shaped so the lower surface 162 will be placed in abutting relation with a portion of the panel profile 47 of a panel 18, as best shown in FIGS. 24-26. When joining one panel 18 to another, such as the second panel 18*b* to the first panel 18*a*, the overlapping or other joining portion, shown as 164 in FIG. 26, of the two panels 18 (i.e., 18*a*/18*b*) will be disposed between and squeezed by the cap member 136 and the panel positioning device 110, as opposed to the single panel 18 shown in FIG. 25. To accomplish the above, the cap profile 158 of the cap members 136 and the device profile 126 of the panel positioning devices 110 will be in opposite, but corresponding configuration to match a portion of the panel profile 47 to which the cap members 136 will be attached. In the figures, the panel positioning devices 110 are sized and configured with a panel profile 47 to match and fit under a rib 44 of the panel 18 (i.e., the rib 44 will be positioned over a panel positioning device 110). Likewise, the cap body 152 of the cap members 136 are sized and configured with a cap profile 158 to match and fit over the rib 44 of the panel 18 (i.e., the cap body 152 will be positioned over the rib 44 of the panel 18). As shown in FIGS. 25-26, the rib 44 of the panel 18 will be securely positioned between and squeezed by the cap member 136 and the panel positioning device 110 on the alignment frame 92 of the panel alignment structure 74.

With each cap member 136 placed in corresponding position with a panel positioning device 110 and the lifting assembly 12 placed on and secured to the panels 18 that will form the panelized section 22 while the panels 18 are on the panelizing assembly 10, the plurality of cap members 136 and panel positioning devices 110 will tightly squeeze the various panels 18 between the lifting assembly 12 and the panelizing assembly 10 to securely hold the panels 18 that will form the panelized section 22 together so the user can easily, quickly and accurately form the panelized section 22. Once all of the cap members 136 are secured to the panelized section 22, as set forth in detail below, the lifting assembly 12 can raise the panelized section 22 off of the panelizing assembly 10 and lift the panelized section 22 into position against the frame 24 of a building 20.

In a preferred configuration, the cap members 136 are made out of steel or other stiff, strong metal with a cap profile 158 that matches the portion of the panel profile 47 of the panel 18 (i.e., the ribs 44 or valleys 46). Alternatively, the cap members 136 can be made out of other materials that are sufficiently stiff and strong to accomplish the objectives of the present invention. In a preferred configuration, each of the cap members 136 has a liner 166 that covers the lower surface 162 of the cap body 152, as shown in FIG. 24, to prevent damage to the outward/upper surface 40 of the panels 18 to which the cap members 136 are attached. The liner 166 can be made out of any material which will cushion or otherwise prevent damage to the panel 18, including materials such as felt, rubber, plastic or the like.

To secure the panel lifters 130 of the lifting assembly 12 to the panel 18 that make up a panelized section 22, the various cap members 136 should have a cap spacing 168 that corresponds to a device spacing 170 of panel positioning devices 110, as shown in FIGS. 10 and 16. The cap members 136 are shown positioned above or on top of panel positioning devices 110 in FIGS. 3 and 5. The equal and aligned cap spacing 168 and device spacing 170 are necessary to ensure that the cap members 136 will be placed on a portion of the panel 18 (such as the rib 44) under which a panel positioning device 110 is located to provide the support necessary to allow the user to place a screw or other connector through the panel 18 or an overlapping or other joining portion 164 of adjacent panels 18 and to provide the stiffness necessary to allow a person to walk on the upper surface 146 of the platforms 150 or other lifter frame 134 when the lifting assembly 12 is on top of a group of panels 18 that will be or have been formed into a panelized section 22. If properly aligned, in one configuration the cap member 136 below the lifter frame 134 (i.e., platform 150) will be over the rib 44 of a panel 18, which rib 44 is supported from below by a panel positioning device 110 that is integral with or attached to the alignment frame 92 (typically a longitudinal frame member 94*a*/94*b* thereof) of the panel alignment structure 74 of the panelizing assembly 10, as shown with regard to the isolated end view of FIG. 25, to create a ballasted squeeze on the panels 18.

In a preferred configuration, each of the cap members 136 are removably attached to the lower surface 148 of the lifter frame 134, such as the platform 150 shown in the figures, with a bolt, screw or like connector. Being removably attached to the lifer frame 134 allows the user to selectively position the cap members 136 along the length of the lifter frame 134 so the cap members 136 will be in alignment with the portion of the panel 18 (i.e., the ribs 44) over which it will be placed and the panel positioning device 110 under the same portion of the panel 18. This configuration will allow an installation company to have one or more sets of panel lifters 130 that can be utilized with a wide range of different types of panels 18 having different panel profiles 47. In an alternative embodiment, the panel lifters 130 can be manufactured for a particular panel profile 47 of a panel 18 and the cap members 136 can be integral with or fixedly attached to the lifter frame 134. In this configuration, the manufacturer of the panels 18 can supply one or more sets of panel lifters 130, with the cap members 136 that are configured and positioned to match the panel profile 47 of the panels 18, to the installers so the installation company can utilize those panel lifters 130 with their lifting assembly 12 to help form and lift panelized sections 22.

Figure 22:
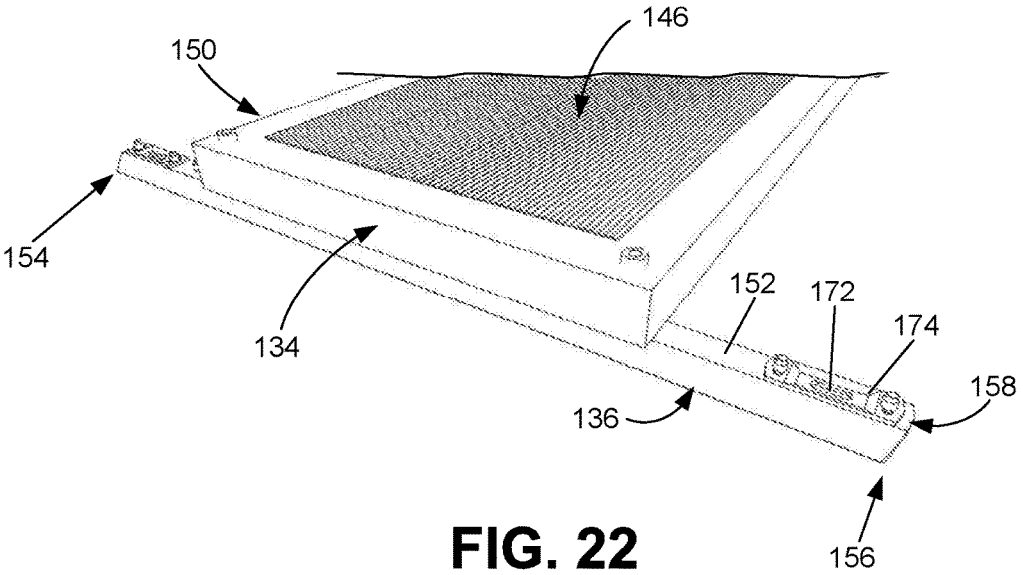
FIG. 22 is an isolated end perspective view of one end of the panel lifter of FIG. 19.
Figure 23:
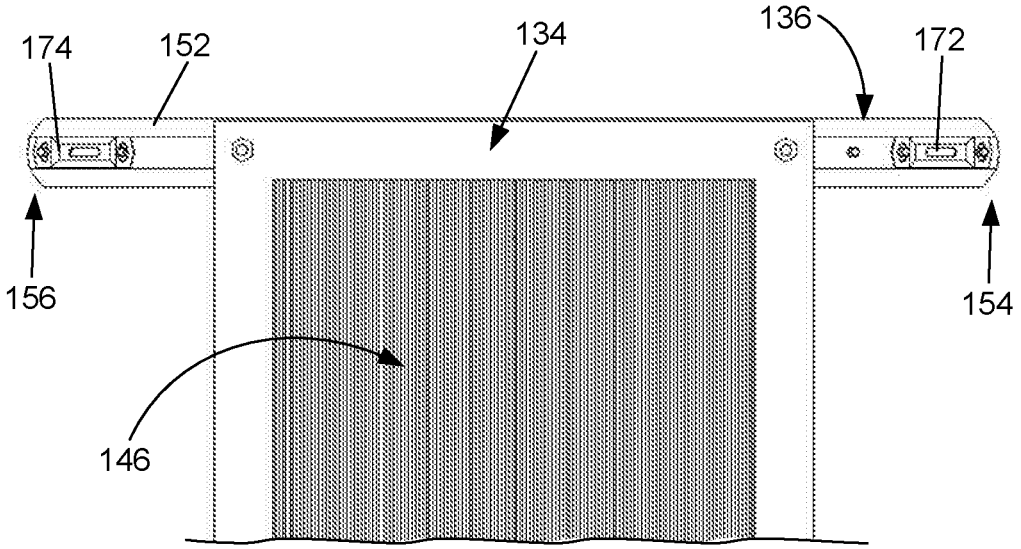
FIG. 23 is an isolated top view of the panel lifter of FIG. 22.

Each end 154/156 of the elongated cap members 136 have one or more mounting apertures 172, best shown in FIGS. 22-23, through the cap body 152 that are sized, configured and positioned for the user to drive or place a screw, bolt or other connector through the cap member 136 into and/or through openings, either created by the user or preformed by the manufacturer, in the panels 18 that are utilized to connect the overlapping or other joining portion 164 of the panels 18, connect the lifting assembly 12 to the panelized section 22 and to securely attach the panels 18 of the panelized section 22 to the frame 24 of the building 20. In one configuration, the mounting apertures 172 are slotted screw holes that are spaced at a specific position to meet the panel manufacturer's specified screw pattern and is aligned to match the predrilled pattern after the panelized section 22 is prepared for installation on the frame 24. Properly positioned mounting apertures 172 will also serve the function of as the anchorage points for the lifting assembly 12, which will eliminate having additional holes, scratches or other hardware for installation of the panelized section 22.

In the embodiments shown in the figures, the lifting assembly 12 also comprises a sliding connector plate 174 associated with each of the mounting apertures 172 of the cap members 136, as best shown in FIGS. 22-23. The sliding connector plate 174 is preferably removably attached to the cap body 152 of the cap members 136 using bolts, screws or other connectors. As shown in FIGS. 22-23, the sliding connector plate 174 is positioned over a mounting aperture 172 such that the user will screw, or otherwise position a connector, through the sliding connector plate 174 to mount the lifting assembly 12 to a panel 18. The primary purposes of the sliding connector plate 174 is to help guide the screw or other connector into the mounting aperture 172 and to avoid, or at least reduce the likelihood of, wearing out the cap member 136. Although the sliding connector plate 174 can be integral with or fixedly attached to the cap member 136, in a preferred configuration the sliding connector plate 174 is removably attached to the cap member 136 so the user can replace the sliding connector plate 174 as may be necessary or desired.

The above describes utilizing screws, bolts or other connectors to with the cap members 136 to attach the panel lifters 130 to the outward/upper surface 40 of the panels 18 that form the panelized section 22 to allow the lifting assembly 12 to attach to and lift the panelized section 22. As will be readily appreciated by persons who are skilled in the art, a wide variety of other attachment mechanisms, other than the cap members 136, can be utilized to removably, but securely, attach the panel lifters 130 to the panels 18 that make up the panelized section 22. The attachment mechanisms can comprise mechanical fasteners, magnets, vacuum systems or the like that are structured and arranged to securely attach the lifting assembly 12 to the panelized section 22 so the panelized section 22 can be raised off of the panelizing assembly 10 and lifted into position against the frame 24 of a building 20 to form the walls 26 and/or roof 28 of the building 20. The use and configuration these, and other, panel attachment mechanisms are generally well known to persons skilled in the art.

The support lift structure 132, which is integral with or attached to the panel lifters 130 of the lifting assembly 12 is utilized to raise the panel lifters 130 and the attached panelized section 22 off of the panelizing assembly 10, lift the panelized section 22 into place against the frame 24 of a building 20 and then lower the lifting assembly 12 back to the panelizing assembly 10 and position the panel lifters 130 on the next set of panels 18 that will form a panelized section 22. The support lift structure 132 generally comprises one or more trusses 176 and one or more spreader frames 178, as shown in FIGS. 3, 5-7, 15-19 and 21. As shown in these figures, there is a truss 176 associated with each panel lifter 130, with the trusses 176 shown as first truss 176*a*, second truss 176*b* and third truss 176*c*, and one or more spreader frames 178 that interconnect the trusses 176 to define the shape and structure of the lifting apparatus 10. In one embodiment, the trusses 176 are integrally formed with or fixedly attached to their associated panel lifters 130 and the spreader frames 178 are integral with or fixedly attached to the trusses 176. In a preferred embodiment of the present invention, as set forth in more detail below, each of the trusses 176 are removably and pivotally attached to their associated panel lifter 130 and the trusses 176 are removably and adjustably secured to the spreader frames 178.

Each of the trusses 176 have a plurality of truss frame members 180 that are structured and arranged to support the lifting assembly 12 and a panelized section 22 as they are raised from the panelizing apparatus and lifted into position against the frame 24 of a building 20. Each of the truss frame members 180 has two or more horizontal frame members 180*a*, one or more vertical frame members 180*b* interconnecting the horizontal frame members 180*a* and a plurality of angled frame members 180*c* that interconnect the horizontal frame members 180*a* and/or the vertical frame members 180*b*. In the embodiment shown in the figures, there is one vertical frame member 180*b* at or near the center of the trusses 176. As will be readily appreciated by persons who are skilled in the art, the trusses 176 will be doing the primary work when moving a panelized section 22. As such, the frame members 180 of the trusses 176 need to be made out of materials and structured and arranged to be sufficiently strong and stiff to accomplish the objectives of raising the lifting assembly 12 and panelized section 22 off of the panelizing assembly 10 and placing the panelized section 22 in position against the frame 24. In one embodiment, the truss frame members 180 are made out of tubular steel or aluminum and fixedly joined together to form the truss 176. A variety of other types of frame members and materials can also be utilized for the trusses 176.

As shown in FIGS. 3, 5-7, 15-19 and 21, each truss 176 is attached to or integral with a panel lifter 130. As set forth above, in the preferred configuration the truss 176 is removably attached to the panel lifter 130, typically the upper surface 146 thereof. In one embodiment, a bracket is utilized to connect the truss 176 to the panel lifter 130. In the preferred embodiment, a pivot mechanism 182 is utilized to pivotally connect the truss 176 to the panel lifter 130, as shown in FIGS. 7, 15, 17-18 and 21. The pivot mechanism 182 can be a pivot joint or the like. The pivot mechanism 182 is utilized to allow the user to more easily and efficiently pivot the panelized section 22 when he or she is placing the panelized section 22 against the portion of the frame 24 of a building 20 that will define the wall 26 or roof 28 of the building 20. The pivot mechanism 182 will facilitate pivoting the panelized section 22 from the horizontal position on top of the panelizing assembly 10 to the vertical or angled position for the wall 26 or roof 28.

Figure 27:
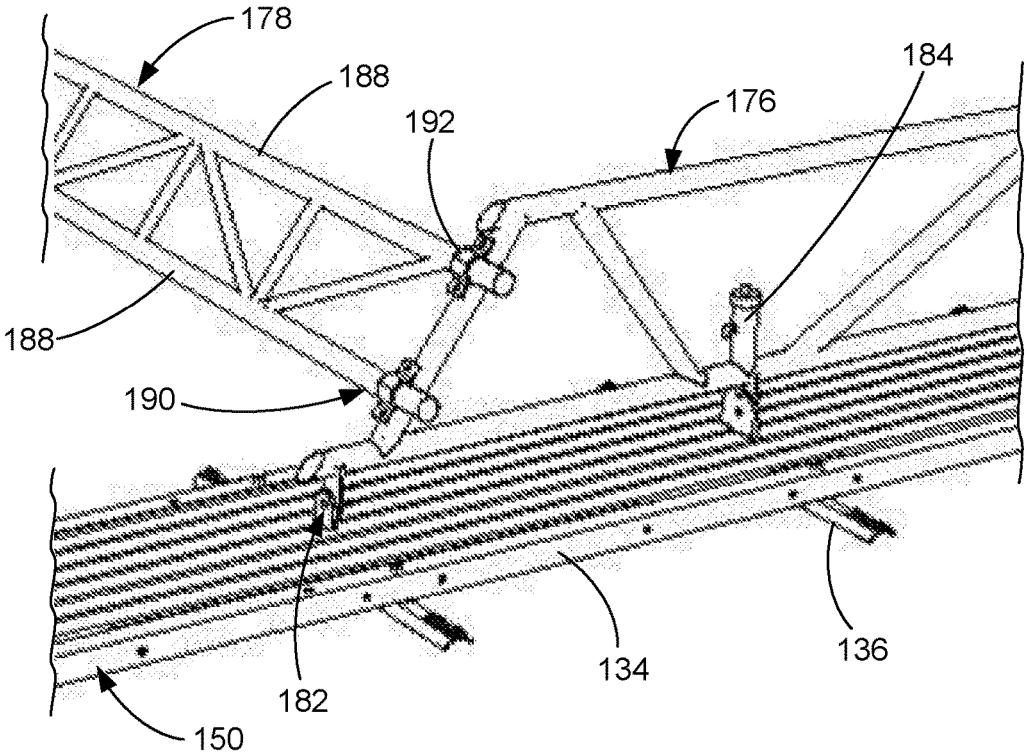
FIG. 27 is an isolated side perspective view of the lifting assembly showing a truss and spreader frame attached to one of the panel lifters to better illustrate the pivoting mechanism and pivot locking device.

In a preferred configuration, the pivot mechanisms 182 are operatively connected to a pivot locking device 184, best shown in FIGS. 15, 17 and 27, that is structured and arranged to allow the user to selectively allow full, partial or no pivoting of the panelized section 22. In the embodiment shown in the figures, the pivot locking device 184 is a cam lock that is structured and arranged to control the pivoting motion of the panel lifters 130, and therefore the panelized section 22, relative to the support lift structure 132. In one configuration, the cam lock device is configured such that when the pivot locking device 184 is disengaged the panel lifters 130 and panelized section 22 will freely pivot, when the pivot locking device 184 is partially engaged the panel lifters 130 and panelized section 22 will controllably pivot and when the pivot locking device 184 is fully engaged the panel lifters 130 and panelized section 22 will not pivot. As will be readily appreciated by persons skilled in the art, other devices can be utilized as the pivot locking device 184 for the lifting assembly 12.

Figure 21:
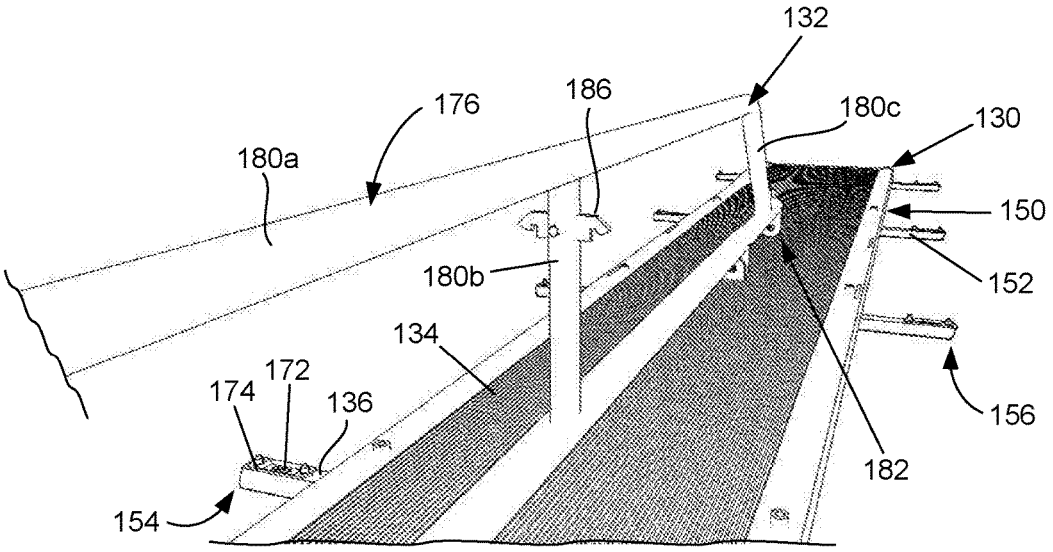
FIG. 21 is an isolated end perspective view of the panel lifter of FIG. 20 with a truss of the support lift structure shown attached to the upper surface thereof.

As best shown in FIG. 21, the support lift structure 132 of the lifting assembly 12 also comprises one or more, preferably a plurality of, latches 186 that are structured and arranged to be utilized to secure the lifting device 12 and the panelized section 22 that is attached thereto in place against the frame 24 of the building 20 for installation of a wall 26 after the panelized section 22 is lifted from its horizontal position on the panelizing assembly 10 to its vertical position against the frame 24. The latches 186 should be structured and arranged and positioned on the support lift structure 132, such as on the trusses 176 thereof, to hold the lifting assembly 12 and panelized section 22 in place while the user attaches the panelized section 22 to the frame 24 of the building 20 with screws or other types of connectors.

As set forth above, the support lift structure 132 also has one or more, typically a plurality of, spreader frames 178 that are structured and arranged to interconnect the trusses 176 and provide the necessary rigidity to the support lift structure 132 so the lifting assembly 12 can lift and position the panelized section 22 to its position against the frame 24. The spreader frames 178 each have a plurality of spreader frame members 188 that are structured and arranged and made out of materials to provide a rigid spreader frame 178 that allows the lifting assembly 12 to be safely lifted and moved by aerial lifting equipment, such as a crane or the like, and to maintain the square or rectangular shape of the panelized section 22 as the panelized section 22 is being moved and positioned against the frame 24 to form the walls 26 and/or roof 28 of the building 20. The spreader frame 178 should be sufficiently rigid to hold the trusses 176 in position relative to each other and to prevent the panelized section 22 from flexing or otherwise moving in an undesirable manner. For use when forming a wall 26, it may only be necessary to utilize two spreader frames 178 should be sufficient. For use when forming the roof 28, it may be beneficial to utilize three spreader frames 178 to provide additional stiffening.

In one embodiment, the spreader frames 178 are a fixed length and the trusses 176 are fixedly attached to or integral with the spreader frames 178. As will be readily appreciated by persons skilled in the art, however, this will be very limiting with regard to the size and configuration of the panelized section 22 with which the lifting assembly 12 can be safely and effectively utilized. In a preferred configuration, the lifting assembly 12 has a length adjusting mechanism 190, as shown in FIG. 27, that is operatively associated with each spreader frame 178 that allows the user to quickly and easily adjust the distance between adjacent trusses 176. In the embodiment shown in FIG. 27, the length adjusting mechanism 190 is configured in a manner that allows the user to move the trusses 176 relative to the spreader frame 178 such that the trusses 176 are closer or further away from each other. In this configuration, the spreader frames are removably connected to the trusses 176 in a manner that allows the trusses 176 to be moved toward or away from each other for different lengths (i.e., between the ends 64/66) of panelized sections 22, based on lengths of the panels 18. In the embodiment shown in FIG. 27, the length adjusting mechanism 190 comprises a pair of U-shaped brackets 192 that are removably mounted (i.e., using bolts, screws or the like) on a truss frame member 180, with the U-shaped brackets 192 being sized and configured to receive one of the spreader frame members 188 and securely attach the spreader frame 178 to the truss 176. To adjust the spacing between the trusses 176, the user simply removes the U-shaped bracket 192 from the truss 176, moves the truss 176 to the desired position on the spreader frame 178, replace the U-shaped bracket 192 around a frame member 188 of the spreader frame 178 and then secure the U-shaped bracket 192 to the truss 176. In an alternative configuration, the spreader frame 178 can be telescopically configured, as the length adjusting mechanism 190) so the user only has to move the telescopically configured section or sections of the spreader frame 178 to adjust the distance between the trusses 176. In this embodiment, the trusses 176 could be fixedly attached to or integral with the spreader frame 178. As will be readily appreciated by persons skilled in the art, a wide variety of other length adjusting mechanisms 190 can be utilized with the spreader frame 178 and the trusses 176 to allow the user to adjust the distance between the trusses 176 for different sizes of panels 18 and/or to otherwise alter the position of the panel lifters 130 of the lifting assembly 12.

Figure 28:
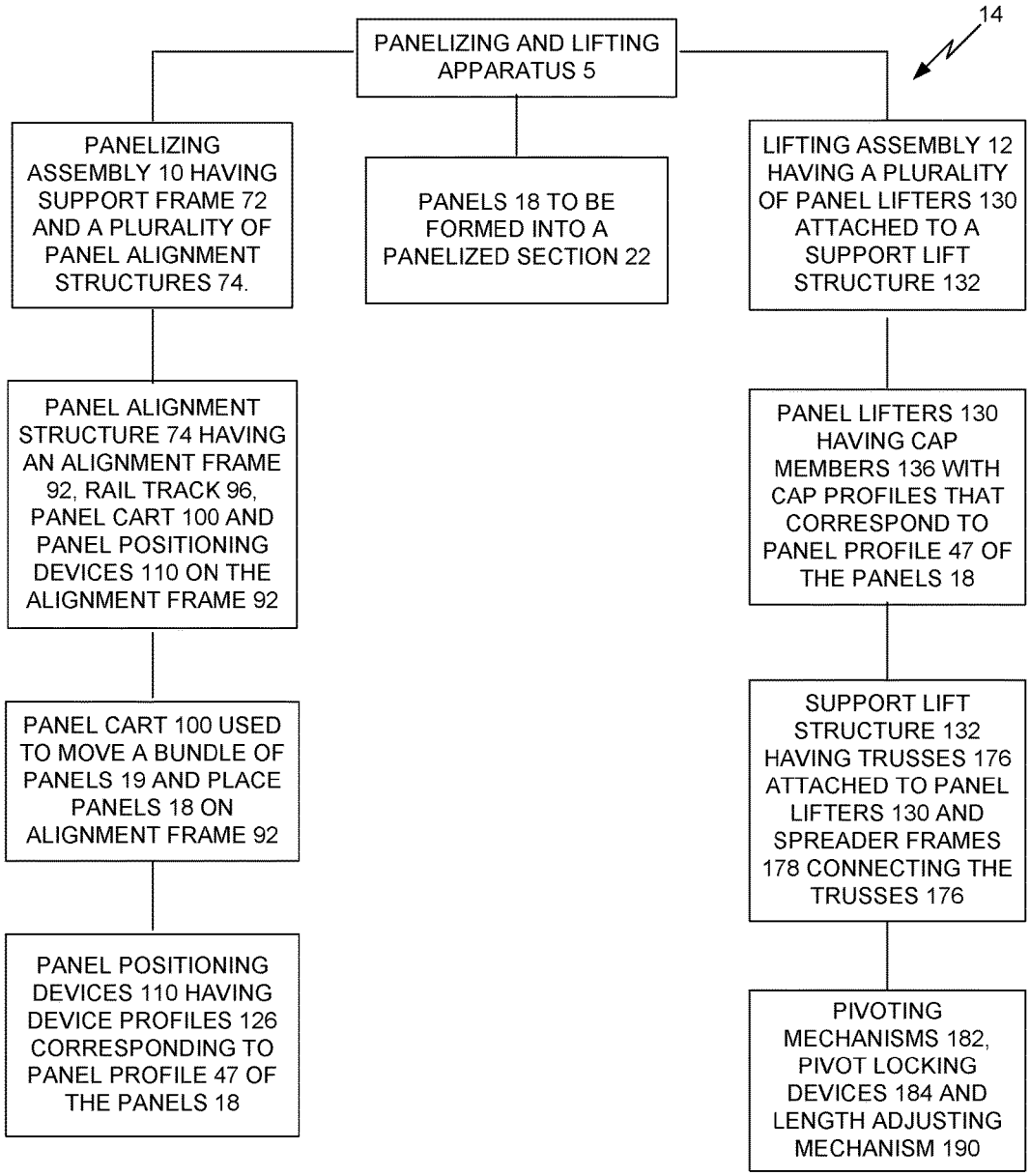
FIG. 28 is a diagram illustrating one of the preferred embodiments of the system of panelizing and installing panels of the present invention.
Figure 29:
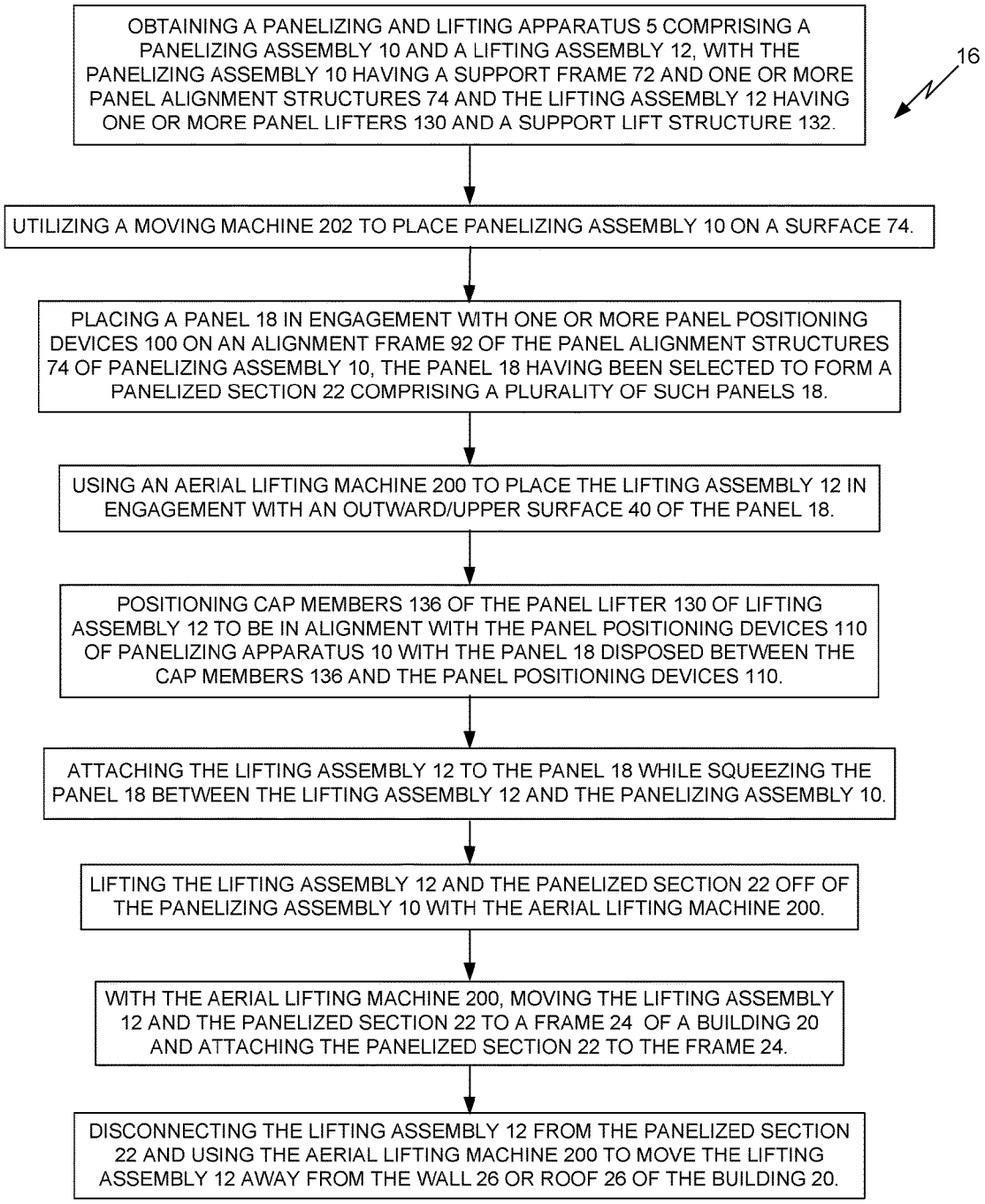
FIG. 29 is a flow chart summarizing one of the preferred embodiments of the method of panelizing and installing panels of the present invention.

The system 14 for panelizing and installing panels 18 of the present invention comprises the panelizing assembly 10 and lifting assembly 12 described above. In addition, as shown in the diagram of FIG. 28, the system 14 comprises a plurality of panels 18 that are panelized by the panelizing assembly 10 into a panelized section 22, a building 20 having a superstructure or frame 24 against which the panelized section 22 will be attached to form, in conjunction with other panelized sections 22, a wall 26 or a roof 28. As set forth above, the panelizing assembly 10 has a support frame 72 which is structured and arranged to support one or more, typically a plurality of, panel alignment structures 74. The panel alignment structures 74 have an alignment frame 92 with at least one, typically a pair of, longitudinal frame members 94*a*/94*b* that define or support a rail track 96 that is structured and arranged to allow a panel cart 100 to move from a panel cart area 128, where the panel cart 100 is stored when not in use, from one side 78 to the opposite side 80 of the support structure 72. The panel cart 100 is utilized to support a bundle of panels 19 and to allow the users to easily, quickly and safely move the bundles of panels 19 and place panels 18 therefrom in position along the alignment frame 92 to form the panelized section 22. The alignment frame 92 has a plurality of specially configured panel positioning devices 110 that facilitate proper and accurate placement of the panels 18 to form the panelized section 22. More specifically, the panel positioning devices 110 have a device profile 126 that is configured in corresponding relation to the panel profile 47 such that when the panel 18 is placed on the alignment frame 92, the panel 18 is held in a position for forming the panelized section 22, with the overlapping or joining portion 164 of the panels 18 ready to be joined together.

Once the panels 18 for the panelized section 18 are in place, the lifting assembly 12 is lowered onto the outward/upper surface 40 of the panels 18. More specifically, an aerial lifting machine 200, such as a crane or the like, is attached to the support lift structure 132 of the lifting assembly 12 and the lifting assembly 12 is positioned on the panels 18 such that the cap members 136 supported by the panel lifters 130 are positioned in corresponding relation to the panel positioning devices 110 under the panels 18. With the cap members 136 having a cap profile 156 in corresponding relation to the panel profile 47 (but opposite the device profile 126 of the panel positioning devices 110), the panels 18 will be pressed between the lifting assembly 12 and the panelizing assembly 10. The user assembles the panelized section 22 and attaches the lifting assembly 12 to the panelized section 22 by inserting connectors, such as screws or the like, through properly positioned mounting apertures 172 near the ends 154/156 of the cap members 136. The trusses 176 and spreader frame 178 of the support lift structure 132 support the panel lifters 130 and maintain the shape of the panelized section 22 as the aerial lifting machine 200 raises the panelized section 22 off of the panelizing assembly 10 and raises the panelized section 22 into place against the frame 24 of a building 20 to form the walls 26 or roof 28 thereof. Because the trusses 176 are pivotally attached to the panel lifters 130 the panelized section 22 can be pivoted into the desired position for the wall 26 or roof 28. One or more pivot locking devices 184 allow the user to allow free pivoting, controlled pivoting or no pivoting of the panel lifters 130 and, therefore, the panelized section 22. Latches 186 help hold the panelized section 22 in place against the frame 24, particularly for the walls 26, while the users secure the panelized section 22 to the frame 24. Once the panelized section 22 is attached, or at least sufficiently attached, the lifting assembly 12 is disconnected and lowered back down by the aerial lifting machine 200 to attach to another group of panels 18.

The method 16 of panelizing and installing panels 18 of the present invention generally comprises the following steps: (1) moving a panelizing assembly 10 to the desired position using a moving machine 202; (2) placing the support frame 72 of the panelizing assembly 10 on a surface 76 near a frame 24 that will define the walls 26 and/or roof 28 of a building 20; (3) positioning the one or more panel alignment structures 74 on the support frame 72 for the panels 18 that will be utilized to form a panelized section 22; (4) securing the panel alignment structures 74 to the support structure 72, with each panel alignment structure 74 having an alignment frame 92 with panel positioning devices 110 located thereon for the panels 18; (5) placing a bundle of panels 19 on a panel cart 100 located at a panel cart area 128 of the panel alignment structure 74 at or near a first side 78 of the support structure 72; (6) moving the panel cart 100 on a rail track 96 that is associated with the alignment frame 92 toward the second side 80 of the support structure 72; (7) removing a panel 18 from the panel cart 100; (8) placing the panel 18 on panel positioning devices 110 on the alignment frame 92, with the panel positioning devices 110 having a device profile configured in corresponding relation with a panel profile 47 of the panels 18 so as to align the panels 18 to form the panelized section 22 and to hold the panels 18 in place on the panel alignment structure 74; (9) lowering a lifting assembly 12 to the panels 18 on the panelizing structure 10 using an aerial lifting machine 200 attached to a support lift structure 132 supporting one or more panel lifters 130 that each have a plurality of cap members 136 on a lower surface 148 thereof; (10) positioning the panel lifters 130 on the panels 18 with the cap members 136 in corresponding relation to the panel positioning devices 110 under the panels 18, with the cap members 136 having a cap profile 156 in corresponding relation to the panel profile 47 (opposite the device profile 126 of the panel positioning devices 110) so the panels 18 will be pressed between the lifting assembly 12 and the panelizing assembly 10; (11) attaching the lifting assembly 12 to the panels 18 and forming the panelized section 22, by joining the overlapping or joining portions 164, using screws or other connectors placed through mounting apertures 172 in the cap members 136; (12) raising the lifting assembly 12 and panelized section 22 off of the panelizing assembly 10 with the aerial lifting machine 200 to position the panelized section at the frame 24 of the building 20: (13) attaching the panelized section 22 to the frame 24 to form a wall 26 or roof 28 of the building 20; and (14) disconnecting the lifting assembly 12 from the panelized section 22. After disconnecting the lifting assembly 12, the user will typically move the lifting assembly 12 back to the panelizing assembly 10 to either attach to and form another panelized section 22 for the wall 26 or roof 28 or place the lifting assembly 12 on the panelizing assembly 10 to store these assemblies 10/12 for later use.

Figure 4:
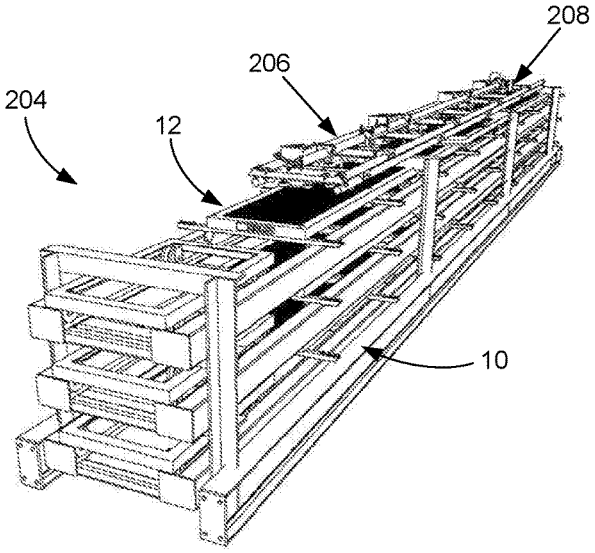
FIG. 4 is a side perspective view of the panelizing and lifting apparatus of FIG. 3 shown with the panelizing assembly and lifting assembly disassembled and combined together as an apparatus bundle, with the apparatus bundle shown having a girt alignment tool and purlin alignment tool combined therewith.

In one of the preferred configurations of the present invention, the panelizing assembly 10 and the lifting assembly 12 can be disassembled and stored together in an apparatus bundle 204, as shown in FIG. 4. The apparatus bundle 204 shown in FIG. 4 contains all of the components set forth above that area necessary for use of the panelizing assembly 10 and the lifting assembly 12 to form the panelized section 22 and to place the panelized section 22 in position against the frame 24 of a building 20. The user can move the apparatus bundle 204 with the aerial lifting machine 200 or the moving machine 202 to a location where use of the assemblies 10/12 will be desired. The apparatus bundle 204 shown in FIG. 4 also stores a girt jack 206 that is structured and arranged to align and support the girts 48 of the frame 24 for installation of the panelized section 22 (or just the panels 18 in prior art installations) to form a wall 26 of the building 20. The apparatus bundle 204 also stores a purlin alignment tool 208 that is structured and arranged to align and maintain the spacing between purlins 50 of the frame 24 of the building 20 for installation of the panelized section 22 (or just the panels 18 in prior art installations) to form the roof 28 of the building 20. The girt jack 206 and the purlin alignment tool 208 are the subject of separate patent applications by the present inventor.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A panelizing and lifting apparatus for panelizing a plurality of panels into a panelized section and installing the panelized section on the frame of a building to form a wall or a roof of the building, said apparatus comprising:

a panelizing assembly having a support frame and one or more panel alignment structures supported by said support frame, each of said panel alignment structures being structured and arranged to receive the plurality of panels thereon and to position the plurality of panels into the panelized section, each of said panel alignment structures having an alignment frame, a rail track attached to or integral with said alignment frame and a panel cart moveably engaged with said rail track so as to move from a panel cart area at a first side of said support frame to a second side of said support frame, said panel cart sized and configured to moveably support a bundle of panels and move said bundle of panels between said first side and said second side of said support frame; and a lifting assembly having a support lift structure and one or more panel lifters attached to or integral with said support lift structure so as to be supported by said support lift structure, said support lift structure being structured and arranged to stiffen said lifting assembly so as to support the panelized section, each of said panel lifters having a plurality of attachment mechanisms structured and arranged to engage the panels positioned on the panelizing assembly so the plurality of panels can be formed into the panelized section and to secure the lifting assembly to the panelized section so the panelized section may be lifted to the frame of the building.

2. The apparatus of claim 1, wherein said panelizing assembly and said lifting assembly are cooperatively configured to squeeze the panelized section between said panel alignment structure and said panel lifters.

3. The apparatus of claim 1, wherein each of said panel alignment structures further comprise a plurality of panel positioning devices attached to or integral with said alignment frame so as to extend above an upper surface thereof, each of said panel positioning devices sized and configured to engage one of the plurality of panels so as to hold the panel on said panelizing assembly.

4. The apparatus of claim 3, wherein each of said panel positioning devices have a device profile sized and configured in corresponding relation to a panel profile of the panel so as to securely engage an inward/lower surface of the panel when the panel is placed on said alignment frame of said panel alignment structure.

5. The apparatus of claim 4, wherein each of said attachment mechanisms have a profile in corresponding relation with the panel profile of the panel so as to securely engage an outward/upper surface of the panel.

6. The apparatus of claim 5, wherein each of said attachment mechanisms are structured and configured to engage the panel opposite the inward/lower surface of the panel engaged by said panel positioning device when said lifting device is placed on the panel so as to squeeze the panel between the attachment mechanism of said lifting assembly and said panel positioning device of said panelizing assembly.

7. The apparatus of claim 1, wherein said alignment frame of each of said panel alignment structures has a plurality of panel positioning devices that are attached to or integral with said alignment frame and configured so as to extend above an upper surface of said alignment frame, each of said panel positioning devices having a device profile configured in corresponding relation to a panel profile of the panels, each of said attachment mechanism comprising a cap member with a cap profile that is in corresponding relation to both the panel profile of the panel and the device profile of the panel positioning device so as to squeeze the panel between said cap member and said alignment frame when said lifting assembly is positioned on the panelized section and the panelized section is on said panelizing assembly.

8. The apparatus of claim 7, wherein each of said cap members have one or more mounting apertures, said mounting apertures sized and positioned to be utilized to connect said cap member to the panel at said panel positioning device so as to secure said lifting assembly to the panelized section.

9. The apparatus of claim 1, wherein said support lift structure of said lifting assembly is pivotally attached to each of said panel lifters so as to allow the panelized section to pivot when the panelized section is lifted by said lifting assembly.

10. The apparatus of claim 1 further comprising a pivot locking device to selectively allow, limit and/or prevent pivoting of said panel lifters relative to said support lift structure.

11. The apparatus of claim 1, wherein said support lift structure comprises one or more trusses and one or more spreader frames, each of said trusses attached to or integral with one of said one or more panel lifters, each of said spreader frames attached to or integral with said one or more trusses.

12. The apparatus of claim 11, wherein said lifting assembly has a plurality of panel lifters and further comprises a length adjusting mechanism associated with said support lift structure, said length adjusting mechanism being structured and arranged to adjust the length of each of said one or more spreader frames so as change the position of at least one of said panel lifters.

13. The apparatus of claim 1, wherein said panelizing apparatus further comprises a length adjusting mechanism, said length adjusting mechanism structured and arranged to change the position of at least one of said one or more panel lifters.

14. A panelizing and lifting system for forming a wall or a roof of a building, said system comprising:

a plurality of panels to be formed into a panelized section, said panelized section structured and arranged to be placed against a frame of the building so as to form the wall or the roof of the building; and a panelizing and lifting apparatus having a panelizing assembly and a lifting assembly, said panelizing assembly comprising a support frame and one or more panel alignment structures supported by said support frame, each of said panel alignment structures being structured and arranged to receive the plurality of panels thereon and to position the plurality of panels into the panelized section, said lifting assembly comprising a support lift structure and one or more panel lifters attached to or integral with said support lift structure so as to be supported by said support lift structure, said support lift structure being structured and arranged to stiffen said lifting assembly so as to support the panelized section, each of said panel lifters having a plurality of attachment mechanisms structured and arranged to engage the panels positioned on the panelizing assembly so the plurality of panels can be formed into the panelized section and to secure the lifting assembly to the panelized section so the panelized section may be lifted to the frame of the building.

15. The system of claim 14, wherein each of said panel alignment structures comprises an alignment frame, a rail track attached to or integral with said alignment frame and a panel cart moveably engaged with said rail track so as to move from a panel cart area at a first side of said support frame to a second side of said support frame, said panel cart sized and configured to moveably support a bundle of panels and move said bundle of panels between said first side and said second side of said support frame.

16. The system of claim 15, wherein each of said panel alignment structures further comprise a plurality of panel positioning devices attached to or integral with said alignment frame so as to extend above an upper surface thereof, each of said panel positioning devices having a device profile sized and configured in corresponding relation to a panel profile of the panel so as to securely engage an inward/lower surface of the panel when the panel is placed on said alignment frame of said panel alignment structure.

17. The system of claim 16, wherein each of said attachment mechanisms have a profile in corresponding relation with the panel profile of the panel so as to securely engage an outward/upper surface of the panel, each of said attachment mechanisms being structured and configured to engage the panel opposite the inward/lower surface of the panel engaged by said panel positioning device when said lifting device is placed on the panel so as to squeeze the panel between the attachment mechanism of said lifting assembly and said panel positioning device of said panelizing assembly.

18. A panelizing and lifting method for forming a wall or a roof of a building, said method comprising the steps of:

(a) obtaining a panelizing and lifting apparatus having a panelizing assembly and a lifting assembly;

(b) placing said panelizing assembly on a surface, said panelizing assembly having a support frame supporting a plurality of panel alignment structures, each of said panel alignment structures having an alignment frame and a plurality of panel positioning devices on said alignment frame, each of said panel positioning devices positioned on said alignment frame so as to extend above an upper surface of said alignment frame, each of said panel positioning devices having a device profile;

(c) placing a panel on said alignment frame in engagement with one or more of said panel positioning devices, said panel selected to form a panelized section comprising a plurality of said panels, said panel having a panel profile, said device profile of each of said panel positioning devices configured in corresponding relation to said panel profile so as to engage an inward/lower surface of said panel;

(d) moving said lifting assembly to be in engagement with an outward/upper surface of said panel, said lifting assembly comprising a support lift structure supporting a plurality of panel lifters, each of said panel lifters having a plurality of cap members, each of said cap members having a cap profile in corresponding relation to said panel profile of the panel;

(e) positioning said cap members so as to be in alignment with panel positioning devices with said panel disposed between said cap members and said panel positioning devices;

(f) attaching said lifting assembly to said panel while squeezing said panel between said lifting assembly and said panelizing assembly to form said panelized section on said panelizing assembly;

(g) lifting said lifting assembly and said panelized section off of said panelizing assembly;

(h) moving said lifting assembly and said panelized section to a frame of the building and attaching said panelized section to said frame to form one of the wall or the roof of the building; and (i) disconnecting said lifting assembly from said panelized section.

19. The method of claim 18, wherein each of said panel alignment structures further comprises a rail track associated with said alignment frame and a panel cart moveably engaged with said rail track an alignment frame, said method further comprising the step of positioning a bundle of panels on said panel cart, moving said panel cart on said rail track and removing said panel from said bundle of panels prior to panel placing step.

20. A panelizing and lifting apparatus for panelizing a plurality of panels into a panelized section and installing the panelized section on the frame of a building to form a wall or a roof of the building, said apparatus comprising:

a panelizing assembly having a support frame and one or more panel alignment structures supported by said support frame, each of said panel alignment structures being structured and arranged to receive the plurality of panels thereon and to position the plurality of panels into the panelized section, each of said panel alignment structures having an alignment frame with a plurality of panel positioning devices that are attached to or integral with said alignment frame and configured so as to extend above an upper surface of said alignment frame, each of said panel positioning devices having a device profile configured in corresponding relation to a panel profile of the panels, each of said attachment mechanism comprising a cap member with a cap profile that is in corresponding relation to both the panel profile of the panel and the device profile of the panel positioning device so as to squeeze the panel between said cap member and said alignment frame when said lifting assembly is positioned on the panelized section and the panelized section is on said panelizing assembly; and a lifting assembly having a support lift structure and one or more panel lifters attached to or integral with said support lift structure so as to be supported by said support lift structure, said support lift structure being structured and arranged to stiffen said lifting assembly so as to support the panelized section, each of said panel lifters having a plurality of attachment mechanisms structured and arranged to engage the panels positioned on the panelizing assembly so the plurality of panels can be formed into the panelized section and to secure the lifting assembly to the panelized section so the panelized section may be lifted to the frame of the building.

21. The apparatus of claim 20, wherein each of said cap members have one or more mounting apertures, said mounting apertures sized and positioned to be utilized to connect said cap member to the panel at said panel positioning device so as to secure said lifting assembly to the panelized section.

22. The apparatus of claim 20, wherein said panelizing assembly and said lifting assembly are cooperatively configured to squeeze the panelized section between said panel alignment structure and said panel lifters.

23. A panelizing and lifting apparatus for panelizing a plurality of panels into a panelized section and installing the panelized section on the frame of a building to form a wall or a roof of the building, said apparatus comprising:

a panelizing assembly having a support frame and one or more panel alignment structures supported by said support frame, each of said panel alignment structures being structured and arranged to receive the plurality of panels thereon and to position the plurality of panels into the panelized section; and a lifting assembly having a support lift structure and a plurality of panel lifters attached to or integral with said support lift structure so as to be supported by said support lift structure, said support lift structure being structured and arranged to stiffen said lifting assembly so as to support the panelized section, said support lift structure having one or more trusses and one or more spreader frames, each of said trusses attached to or integral with one of said one or more panel lifters, each of said spreader frames attached to or integral with said one or more trusses, each of said panel lifters having a plurality of attachment mechanisms structured and arranged to engage the panels positioned on the panelizing assembly so the plurality of panels can be formed into the panelized section and to secure the lifting assembly to the panelized section so the panelized section may be lifted to the frame of the building, said lifting assembly further comprising a length adjusting mechanism associated with said support lift structure, said length adjusting mechanism being structured and arranged to adjust the length of each of said one or more spreader frames so as change the position of at least one of said panel lifters.

24. The apparatus of claim 23, wherein said panelizing assembly and said lifting assembly are cooperatively configured to squeeze the panelized section between said panel alignment structure and said panel lifters.

25. The apparatus of claim 23, wherein each of said panel alignment structures has an alignment frame with a plurality of panel positioning devices that are attached to or integral with said alignment frame and configured so as to extend above an upper surface of said alignment frame, each of said panel positioning devices having a device profile configured in corresponding relation to a panel profile of the panels, each of said attachment mechanism comprising a cap member with a cap profile that is in corresponding relation to both the panel profile of the panel and the device profile of the panel positioning device so as to squeeze the panel between said cap member and said alignment frame when said lifting assembly is positioned on the panelized section and the panelized section is on said panelizing assembly.

* * * * *